US005693206A

United States Patent [19]

Castegnier et al.

[11] Patent Number: 5,693,206

[45] Date of Patent: Dec. 2, 1997

[54] ELECTROCOAGULATION PRINTING APPARATUS

[75] Inventors: Adrien Castegnier, Outremont; Normand Lepine, Pointe-aux-Trembles; Gilles Gadbois, Rawdon; Christian Laplante, Chateauguay, all of Canada

[73] Assignee: Elcorsy Technology Inc., St. Laurent, Canada

[21] Appl. No.: 665,458

[22] Filed: Jun. 18, 1996

[51] Int. Cl.[6] ..... B41L 19/00

[52] U.S. Cl. ..... 204/623; 204/483; 204/486; 204/489; 204/492; 204/493; 204/495; 204/508; 204/624; 101/465; 101/466; 101/489; 101/DIG. 37

[58] Field of Search ..... 204/483, 486, 204/489, 492, 493, 495, 508, 623, 624; 101/465, 466, 489, DIG. 37

[56] References Cited

U.S. PATENT DOCUMENTS

| | | | |
|---|---|---|---|
| 4,895,629 | 1/1990 | Castegnier et al. | 204/483 |
| 5,449,392 | 9/1995 | Castegnier et al. | 218/46 |
| 5,538,601 | 7/1996 | Castegnier | 204/486 |

*Primary Examiner*—Kathryn L. Gorgos
*Assistant Examiner*—John S. Starsiak, Jr.
*Attorney, Agent, or Firm*—Swabey Ogilvy Renault

[57] ABSTRACT

An electrocoagulation printing apparatus comprises a positive cylindrical electrode having a central longitudinal axis extending horizontally and a passivated surface defining a positive electrode active surface, the positive electrode being formed of an electrolytically inert metal; a drive mechanism for rotating the positive electrode about the longitudinal axis thereof at a substantially constant speed; a coating device for coating the positive electrode active surface with an olefinic substance and a metal oxide to form on the surface micro-droplets of olefinic substance containing the metal oxide; and a printing head for forming on the olefin and metal oxide-coated positive electrode active surface a plurality of dots of colored, coagulated colloid by electrocoagulation of an electrolytically coagulable colloid in the presence of a coloring agent, the dots of colored, coagulated colloid being representative of a desired image. The apparatus of the invention further comprises a transfer device for bringing a substrate into contact with the dots of colored, coagulated colloid to cause transfer of the colored, coagulated colloid from the positive electrode active surface onto the substrate and thereby imprint the substrate with the image; and a cleaning device for cleaning the positive electrode active surface to remove therefrom any remaining coagulated colloid, the cleaning device being disposed under the positive electrode and below the coating device. Such an apparatus is capable of printing images of high definition.

90 Claims, 13 Drawing Sheets

ELECTROCOAGULATION PRINTING APPARATUS

BACKGROUND OF THE INVENTION

The present invention pertains to improvements in the field of electrocoagulation printing. More particularly, the invention relates to an improved apparatus for reproducing an image by electrocoagulation of an electrolytically coagulable colloid and transferring the image thus reproduced onto a substrate.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the surface of the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is then cleaned to remove therefrom any remaining coagulated colloid.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation with the positive electrode of each printing unit extending horizontally, to produce several differently colored images of coagulated colloid which are transferred at respective transfer stations onto the substrate in superimposed relation to provide the desired polychromic image. Alternatively, the printing units can be arranged around a single vertically extending roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

Applicant has observed that when use is made of a single vertically extending roller around which are arranged the printing units with the positive electrodes thereof also extending vertically, the upper portions of the roller and positive electrodes are subjected to flexion forces which are much higher than those encountered at the lower portions of the roller and positive electrodes, unless great expenditure is incurred to support the upper portions so as to prevent flexion thereof. Thus, a variation in the pressure exerted by each positive electrode against the roller occurs between the upper and lower portions of the roller and each positive electrode and such a variation in pressure may range from about 5 to about 15 kg/cm$^2$, resulting in improper transfer of the colored, coagulated colloid from the positive electrodes onto the substrate and improper superimposition of the differently colored images.

On the other hand, when the printing units are disposed in tandem relation with the positive electrode of each printing unit extending horizontally, the positive electrode coating device of each printing unit is often contaminated with cleaning fluid leaking from the positive electrode cleaning device located above the coating device. In such instances, the printing apparatus must be shut down so as to empty the coating device and replenish same with fresh dispersion containing the olefin substance and metal oxide.

SUMMARY OF THE INVENTION

It is therefore an object of the present invention to overcome the above drawbacks and to provide an improved electrocoagulation printing apparatus which is capable of providing a mono- or polychromic image of high definition, without contamination of the positive electrode coating device.

According to one aspect of the invention, there is provided an electrocoagulation printing apparatus comprising:

- a positive cylindrical electrode having a central longitudinal axis extending horizontally and a passivated surface defining a positive electrode active surface, the positive electrode being formed of an electrolytically inert metal;
- means for rotating the positive electrode about the longitudinal axis thereof at a substantially constant speed;
- coating means for coating the positive electrode active surface with an olefinic substance and a metal oxide to form on the surface micro-droplets of olefinic substance containing the metal oxide;
- means for forming on the olefin and metal oxide-coated positive electrode active surface a plurality of dots of colored, coagulated colloid by electrocoagulation of an electrolytically coagulable colloid in the presence of a coloring agent, the dots of colored, coagulated colloid being representative of a desired image;
- means for bringing a substrate into contact with the dots of colored, coagulated colloid to cause transfer of the colored, coagulated colloid from the positive electrode active surface onto the substrate and thereby imprint the substrate with the image; and
- cleaning means for cleaning the positive electrode active surface to remove therefrom any remaining coagulated colloid, the cleaning means being disposed under the positive electrode and below the coating means.

The present invention also provides, in another aspect thereof, a multicolor electrocoagulation printing apparatus comprising a plurality of printing units arranged in tandem relation and each including:

- a positive cylindrical electrode having a central longitudinal axis extending horizontally and a passivated surface defining a positive electrode active surface, the positive electrode being formed of an electrolytically inert metal;

means for rotating the positive electrode about the longitudinal axis thereof at a substantially constant speed;

coating means for coating the positive electrode active surface with an olefinic substance and a metal oxide to form on the surface micro-droplets of olefinic substance containing the metal oxide;

means for forming on the olefin and metal oxide-coated positive electrode active surface a plurality of dots of colored, coagulated colloid by electrocoagulation of an electrolytically coagulable colloid in the presence of a coloring agent of different color, the dots of colored, coagulated colloid being representative of a desired image;

means for bringing a substrate into contact with the dots of colored, coagulated colloid at a respective transfer station to cause transfer of the colored, coagulated colloid from the positive electrode active surface onto the substrate and thereby imprint the substrate with the image; and cleaning means for cleaning the positive electrode active surface to remove therefrom any remaining coagulated colloid, the cleaning means being disposed under the positive electrode and below the coating means; whereby to produce several differently colored images of coagulated colloid which are transferred at the respective transfer stations onto the substrate in superimposed relation to provide a polychromic image.

According to a preferred embodiment of the invention, the coating means comprises first and second distribution rollers arranged in spaced-apart parallel relation to one another and to the positive electrode, the first and second distribution rollers each having a peripheral coating comprising an oxide ceramic material, and applicator means for applying the olefinic substance in the form of an oily dispersion containing the metal oxide as dispersed phase onto the ceramic coating of the first distribution roller to form on a surface thereof a film of the oily dispersion uniformly covering the surface of the ceramic coating, the film of oily dispersion at least partially breaking down into micro-droplets containing the olefinic substance in admixture with the metal oxide and having substantially uniform size and distribution. The coating means further includes first transfer means arranged between the first distribution roller and the second distribution roller for transferring the at least partially broken film from the first distribution to the second distribution roller so as to cause the film to substantially completely break on the ceramic coating of the second distribution roller into the micro-droplets having a substantially uniform size and distribution, and second transfer means arranged between the second distribution roller and the positive electrode for transferring the micro-droplets from the ceramic coating of the second distribution roller onto the positive electrode active surface.

As explained in Applicant's U.S. Pat. No. 5,449,392 of Sep. 12, 1995, the teaching of which is incorporated herein by reference, the use of a distribution roller having a ceramic coating comprising an oxide ceramic material enables one to form on a surface of such a coating a film of the oily dispersion which uniformly covers the surface of the ceramic coating and thereafter breaks down into micro-droplets containing the olefinic substance in admixture with the metal oxide and having substantially uniform size and distribution. The micro-droplets formed on the surface of the ceramic coating and transferred onto the positive electrode active surface generally have a size ranging from about 1 to about 5μ. The provision of two distribution rollers ensures that the film of oily dispersion substantially completely breaks down on the surface of the ceramic coating of the second distribution roller into the desired micro-droplets, should the film of oily dispersion only partially break down on the surface of the ceramic coating of the first distribution roller into micro-droplets.

A particularly preferred oxide ceramic material forming the aforesaid ceramic coating comprises a fused mixture alumina and titania. Such a mixture may comprise about 60 to about 90 weight % of alumina and about 10 to about 40 weight % of titania.

Preferably, the applicator means comprises an applicator roller extending parallel to the first distribution roller and in pressure contact engagement therewith to form a first nip, means for rotating the applicator roller and the first distribution roller in register and feed means for supplying the oily dispersion to the applicator roller, whereby the oily dispersion is carried to the first nip by the applicator roller during rotation thereof and upon passing through the first nip forms a film uniformly covering the surface of the ceramic coating of the first distribution roller.

According to another preferred embodiment, the first transfer means comprises a first transfer roller extending parallel to the first and second distribution rollers, in pressure contact engagement with the first distribution roller to form a second nip and in contact engagement with the second distribution roller to form a third nip, and means for rotating the first transfer roller and the first distribution roller in register, whereby the at least partially broken film is transferred from the first distribution roller to the first transfer roller at the second nip and thereafter from the first transfer roller to the second distribution roller at the third nip. The second transfer means advantageously comprises a second transfer roller extending parallel to the second distribution roller and in pressure contact engagement therewith to form a fourth nip, the second transfer roller being in pressure contact engagement with the positive electrode to form a fifth nip and permit the second transfer roller to be driven by the positive electrode and the second distribution roller to be driven by the second transfer roller upon rotation of the positive electrode, whereby the micro-droplets are transferred from the second distribution roller to the second transfer roller at the fourth nip and thereafter from the second transfer roller to the positive electrode at the fifth nip.

Examples of suitable olefinic substances which may be used to coat the surface of the positive electrode include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. As noted above, the olefinic substance is advantageously applied onto the positive electrode active surface in the form of an oily dispersion containing the metal oxide as dispersed phase. Examples of suitable metal oxides include aluminum oxide, ceric oxide, chromium oxide, cupric oxide, iron oxide, magnesium oxide, manganese oxide, titanium dioxide and zinc oxide; chromium oxide is the preferred metal oxide. Depending on the type of metal oxide used, the amount of metal oxide may range from about 20 to about 60% by weight, based on the total weight of the dispersion. Preferably, the olefinic substance and the metal oxide are present in the dispersion in substantially equal amounts. A particularly preferred dispersion contains about 50 wt. % of oleic acid or linoleic acid and about 50 wt. % of chromium oxide.

In a particularly preferred embodiment, the apparatus of the invention further includes means for moving the first and second distribution rollers between a working position whereat the first distribution roller is in the aforesaid engagement with the first transfer roller and the second distribution roller is in the aforesaid engagement with the second transfer roller, and a non-working position whereat the first distribution roller is disengaged from the first transfer roller and the second distribution roller is disengaged from the second transfer roller. The applicator roller, the first and second distribution rollers and the first transfer rollers have respectively first, second, third and fourth central longitudinally extending shafts and are mounted between opposite vertically extending first and second plate members with the ends of the second and third shafts being movable in openings defined through the plate members. Preferably, the means for moving the first and second distribution rollers between the working and non-working positions comprises a first pair of opposite elongated arms each pivotally connected at one end to a respective end of the first shaft and at the other end to a respective end of the second shaft for pivotal movement about the first shaft, a second pair of opposite elongated arms each pivotally connected at one end to the respective end of the second shaft and at the other end to a respective end of the third shaft, a third pair of opposite elongated arms each pivotally connected at one end to the respective end of the third shaft and at the other end to a respective end of the fourth shaft for pivotal movement about the fourth shaft, whereby the first and second distribution rollers are movable in directions towards or away from the first and second transfer rollers, respectively, and actuating means for pivotally moving the arms of the first pair and thereby pivotally moving the arms of the third pair, whereby to move the first and second distribution rollers towards or away from the first and second transfer rollers, respectively, and thereby move same between the working and non-working positions.

According to a further preferred embodiment, the positive electrode is mounted between opposite vertically extending third and fourth plate members, and the actuating means comprises a pair of opposite elongated actuator arms each connected at a first end thereof to a respective arm of the first pair, a pair of opposite elongated link members each pivotally connected at a first end thereof to a second end of a respective actuator arm and hydraulic means connected between a second end of each link member and a respective one of the third and fourth plate members, whereby when the link members and the actuator arms are moved by the hydraulic means in a first direction the first and second distribution rollers are moved to the working position, and when the link members and the actuator arms are moved by the hydraulic means in a second direction opposite the first direction the first and second distribution rollers are moved to the non-working position.

According to yet another preferred embodiment, the apparatus of the invention further includes means for moving the second transfer roller between a working position whereat the second transfer roller is in the aforesaid engagement with the positive electrode, and a non-working position whereat the second transfer roller is disengaged from the positive electrode. Preferably, the first and second plate members are pivotally connected respectively to the third and fourth plate members for pivotal movement about a pivot axis extending parallel to the longitudinal axis of the positive electrode, the second transfer roller being mounted between the first and second plate members, whereby the transfer roller is movable in a direction towards or away from the positive electrode. The means for moving the second transfer roller between the working and non-working positions comprises abutment means on the first and second plate members for engaging the actuator arms when the link members and the actuator arms are moved by the hydraulic means in the first direction such that the actuator arms abut against the abutment means and thereby pivotally move the first and second plate members with the second transfer roller therebetween towards the positive electrode, whereby the second transfer roller is moved to the working position. The first and second plate members, the applicator roller, the first and second distribution rollers and the first and second transfer rollers are disposed relative to the aforesaid pivot axis to provide a weight distribution such as to cause the first and second plate members to pivotally move away from the positive electrode when the link members and the actuator arms are moved in the second direction, whereby the second transfer roller is moved to the non-working position.

The means for forming the dots of colored, coagulated colloid advantageously comprises:

a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined electrode gap, the negative electrodes being spaced from one another by a distance at least equal to the electrode gap;

means for filling the electrode gap with a substantially liquid colloidal dispersion containing the electrolytically coagulable colloid, the coloring agent, a liquid dispersing medium and a soluble electrolyte;

means for electrically energizing selected ones of the negative electrodes to cause point-by-point selective coagulation and adherence of the colloid onto the olefin and metal oxide-coated positive electrode active surface opposite the electrode active surfaces of the energized negative electrodes while the positive electrode is rotating, thereby forming the dots of colored, coagulated colloid; and means for removing any remaining non-coagulated colloid from the positive electrode active surface.

As explained in U.S. Pat. No. 4,895,629, the teaching of which is incorporated herein by reference, spacing of the negative electrodes from one another by a distance which is equal to or greater than the electrode gap prevents the negative electrodes from undergoing edge corrosion. On the other hand, coating of the positive electrode with an olefinic substance and a metal oxide prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable electrolytically inert metals from which the positive and negative electrodes can be made are stainless steel, chromium, nickel and aluminum. The positive electrode is preferably made of stainless steel or aluminum so that upon electrical energization of the negative electrodes, dissolution of the passive oxide film on such an electrode generates trivalent ions which then initiate coagulation of the colloid.

The gap which is defined between the positive and negative electrodes can range from about 50μ to about 100μ, the smaller the electrode gap the sharper are the dots of coagulated colloid produced. Where the electrode gap is of the order of 50μ, the negative electrodes are the preferably spaced from one another by a distance of about 75μ.

The colloid generally used is a linear colloid of high molecular weight, that is, one having a weight average molecular weight comprised between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a molecular weight of about 250,000 and sold by Cyanamid inc. under the trade mark ACCOSTRENGTH 86. The colloid is preferably used in an amount of about 6.5 to about 12% by weight, and more preferably in an amount of about 7% by weight, based on the total weight of the colloidal dispersion. Water is preferably used as the medium for dispersing the colloid to provide the desired colloidal dispersion.

The colloidal dispersion also contains a soluble electrolyte and a coloring agent. Preferred electrolytes include alkali metal halides and alkaline earth metal halides, such as lithium chloride, sodium chloride, potassium chloride and calcium chloride. The electrolyte is preferably used in an amount of about 6.5 to about 9% by weight, based on the total weight of the dispersion. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the dispersion. Examples of suitable dispersing agents include the non-ionic dispersing agent sold by ICI Canada Inc. under the trade mark SOLSPERSE 27000. The pigment is preferably used in an amount of about 6.5 to about 12% by weight, and the dispersing agent in an amount of about 0.4 to about 6% by weight, based on the total weight of the dispersion.

After coagulation of the colloid, any remaining non-coagulated colloid is removed from the positive electrode active surface so as to fully uncover the colored, coagulated colloid. The means for removing the non-coagulated colloid from the positive electrode active surface advantageously comprises an elongated blade member of resilient material extending parallel to the longitudinal axis of the positive electrode and in pressure contact engagement with the positive electrode active surface for retaining upstream of the blade member excess colloidal dispersion flowing through the electrode gap and carried by the positive electrode, and suction means for sucking up the excess colloidal dispersion retained by the blade member. Preferably, the suction means includes a suction head having an elongated body extending parallel to the blade member, the body being provided with conduit means opening closely adjacent the blade member and adapted for connection to suction pump means.

According to still another preferred embodiment, the apparatus of the invention further includes pressure adjustment means for adjustably varying the pressure exerted between the blade member and the positive electrode active surface. Preferably, the blade member is mounted to an elongated support member and extends longitudinally thereof, the support member being displaceably mounted to the body of the suction head for movement in a direction towards or away from the positive electrode, and the pressure adjustment means comprises means for adjustably moving the support member towards or away from the positive electrode to thereby vary the pressure exerted by the blade member against the positive electrode active surface. The means for adjustably moving the support member towards or away from the positive electrode advantageously comprises adjustable screw means threadedly engaged with the body of the suction head and contacting the support member, and spring means urging the support member against the screw means to retain the support member in contact engagement with the screw means. Preferably, an elongated attachment member extending parallel to the body of the suction head is slidably mounted thereto for movement in a direction towards or away from the positive electrode, and the support member is removably fixed to the attachment member so as to be displaceable therewith in the direction.

BRIEF DESCRIPTION OF THE DRAWINGS

Further features and advantages of the invention will become more readily apparent from the following description of preferred embodiments as illustrated by way of examples in the accompanying drawings, in which:

FIG. 16 is a fragmentary sectional view of the printing unit shown in FIG. 2, illustrating the cleaning device used for cleaning the surface of the positive electrode.

DESCRIPTION OF PREFERRED EMBODIMENTS

Figure 1:
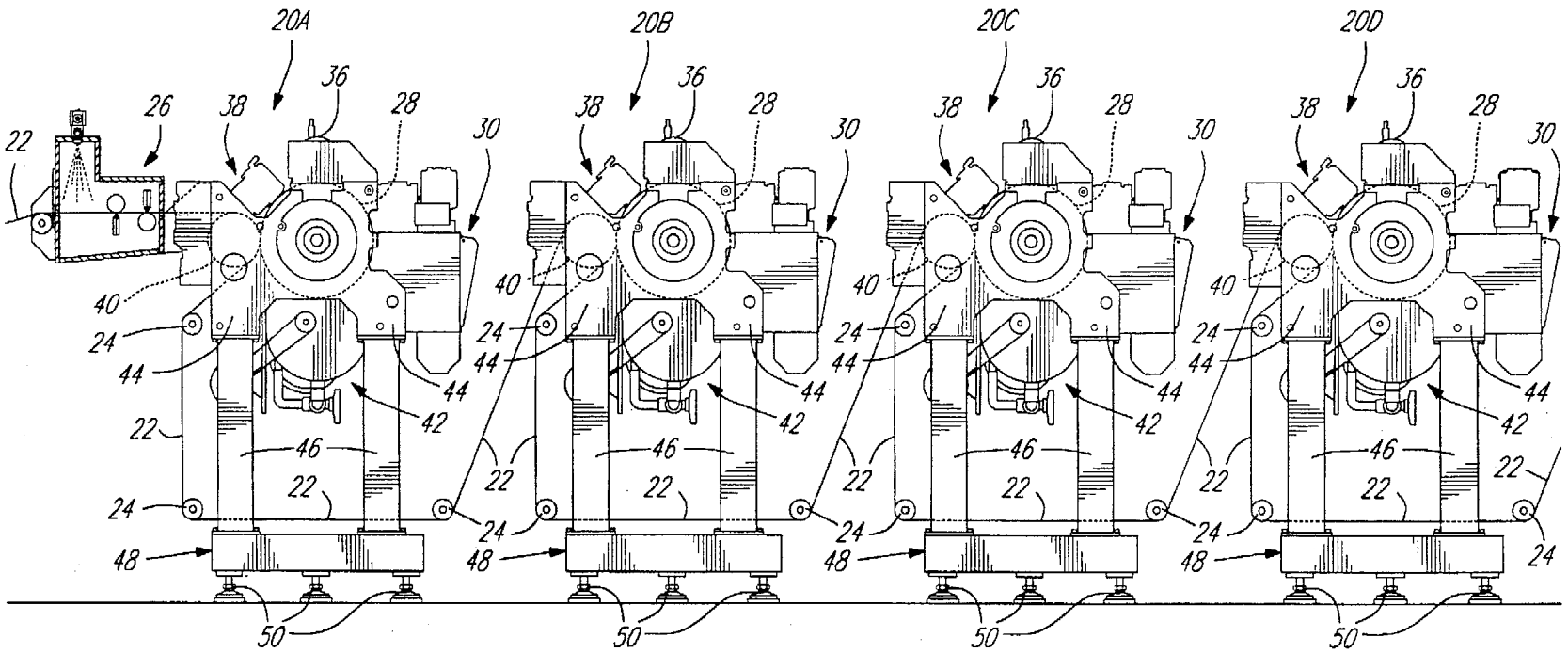
FIG. 1 is a side elevational view of an electrocoagulation printing apparatus according to a preferred embodiment of the invention, comprising four printing units each using a coloring agent of different color.

Referring first to FIG. 1, there is illustrated a multicolor electrocoagulation printing apparatus comprising four identical printing units 20 arranged in tandem relation, but each using a coloring agent of different color. In the embodiment shown, the first printing unit 20A at the left of the figure is adapted to print in yellow color, the second printing unit 20B in magenta color, the third printing unit 20C in cyan color and the fourth printing unit 20D in black color. A substrate in the form of a continuous web 22 is fed to the printing units 20 for being imprinted with differently colored images which are transferred at respective transfer stations onto the web in superimposed relation to provide a polychromic image, the web 22 being guided to the respective transfer stations by guide rollers 24. A humidifier 26 is provided for humidifying the web 22 prior to passing through the transfer station of the first printing unit 20A.

Figure 2:
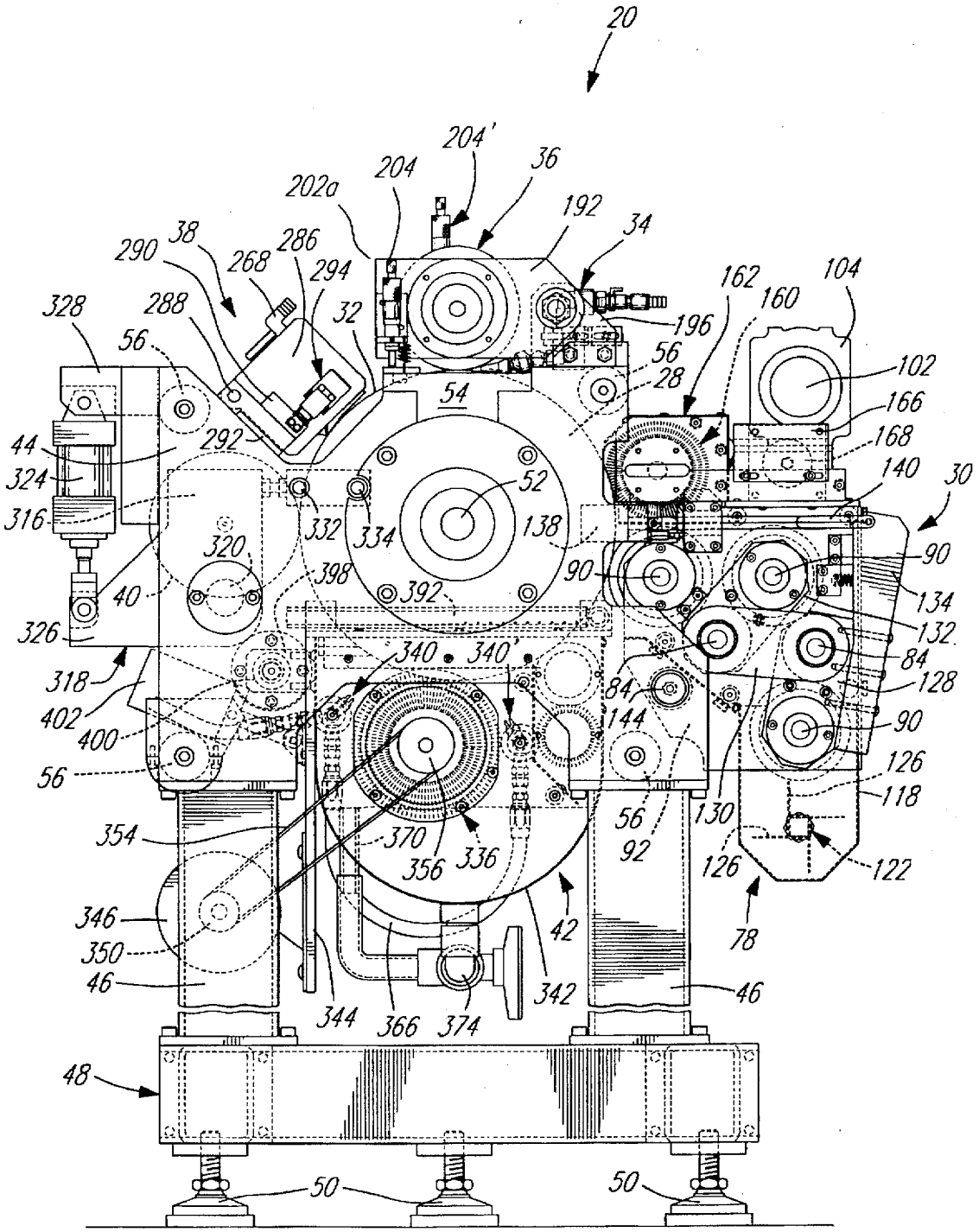
FIG. 2 is a side elevational view of one of the printing units illustrated in FIG. 1.

As best shown in FIG. 2, the printing units 20 each comprise a positive electrode 28 in the form of a revolving cylinder, a positive electrode coating device 30 for coating the surface 32 of the positive electrode 28 with an olefinic substance and a metal oxide, a colloid injector 34, a printing head 36 provided with negative electrodes for electrocoagulating the colloid to form on the positive electrode surface 32 dots of colored, coagulated colloid representative of a desired image and a device 38 for removing any non-coagulated colloid from the surface 32. Each printing unit 20 further includes a pressure roller 40 for bringing the web 22 into contact with the dots of colored, coagulated colloid to cause transfer of the colored, coagulated colloid onto the web 22 and thereby imprint the web with the image. A positive electrode cleaning device 42 is also provided for cleaning the surface 32 and thus removing any remaining coagulated colloid from the surface after transfer of the dots of colored, coagulated colloid onto the web 22.

The positive electrode 28 is mounted between a pair of opposite vertical plates 44 and 44' (plate 44' being shown in FIG. 4) each fixedly mounted on a pair of legs 46 (only one pair shown) which are fixed to a base frame 48 provided with feet 50. The cylindrical electrode 28 has a shaft 52 which is driven by a motor (not shown) for rotating the electrode about a horizontal axis coincident with the shaft 52. The plates 44,44' are provided with T-shaped notches which are closed by removable T-shaped members 54,54' (member 54' being shown in FIGS. 4 and 14). Removal of the members 54,54' enables one to easily withdraw the electrode 28 from the unit 20 when servicing is required. A plurality of cylindrical brace members 56 interconnect the plates 44 and 44'.

Turning to FIGS. 3–7, the positive electrode coating device 30 comprises two horizontally extending distribution rollers 58 and 60 spaced from one another, an applicator roller 62 extending parallel to the distribution roller 58 and in pressure contact engagement therewith to form a nip 64, a transfer roller 66 arranged between the distribution rollers 58,60 and extending parallel thereto, the transfer roller 66 being in pressure contact engagement with the distribution roller 58 to form a nip 68 and in contact engagement with the distribution roller 60 to form a nip 70, and a second transfer roller 72 arranged between the distribution roller 60 and the positive electrode 28. The transfer roller 72 extends parallel to the distribution roller 60 and in pressure contact engagement therewith to form a nip 74. The transfer roller 72 is also in pressure contact engagement with the positive electrode 28 to form a nip 76 and permit the roller 72 to be driven by the electrode 28 and the roller 60 to be driven by the roller 72 upon rotation of the electrode 28. The coating device 30 further includes a feeding system 78 for supplying to the applicator roller 62 the olefinic substance in the form of an oily dispersion containing the metal oxide as dispersed phase.

The distribution rollers 58 and 60 have a solid core 80 of metal provided with a peripheral coating 82 of oxide ceramic material. A pair of stub shafts 84,84' integral with the core 80 extends outwardly from the extremities of each roller. The applicator roller 62 and the transfer rollers 66,72, on the other hand, each have a tubular core 86 provided with a peripheral covering 88 of polyurethane, and a central longitudinally extending shaft 90. The polyurethane covering 88 of roller 62 has a Shore A hardness of about 35 to 45, whereas the polyurethane coverings 88 of rollers 66,72 have a Shore A hardness of about 65 to 75. Polyurethane is a synthetic rubber material which is resistant to attack by oil. The rollers 58, 60, 62, 66 and 72 are rotatably mounted between a pair of opposite vertical plates 92,92' with the stub shafts 84,84' of rollers 58,60 being movable in oblong shaft openings (not shown) formed through the plates 92,92'. A plurality of cylindrical brace members 94 interconnect the plates 92,92', a top plate 96, rear plate 98 and inclined bottom plate 100 being fixed to the brace members 94.

Figure 4:
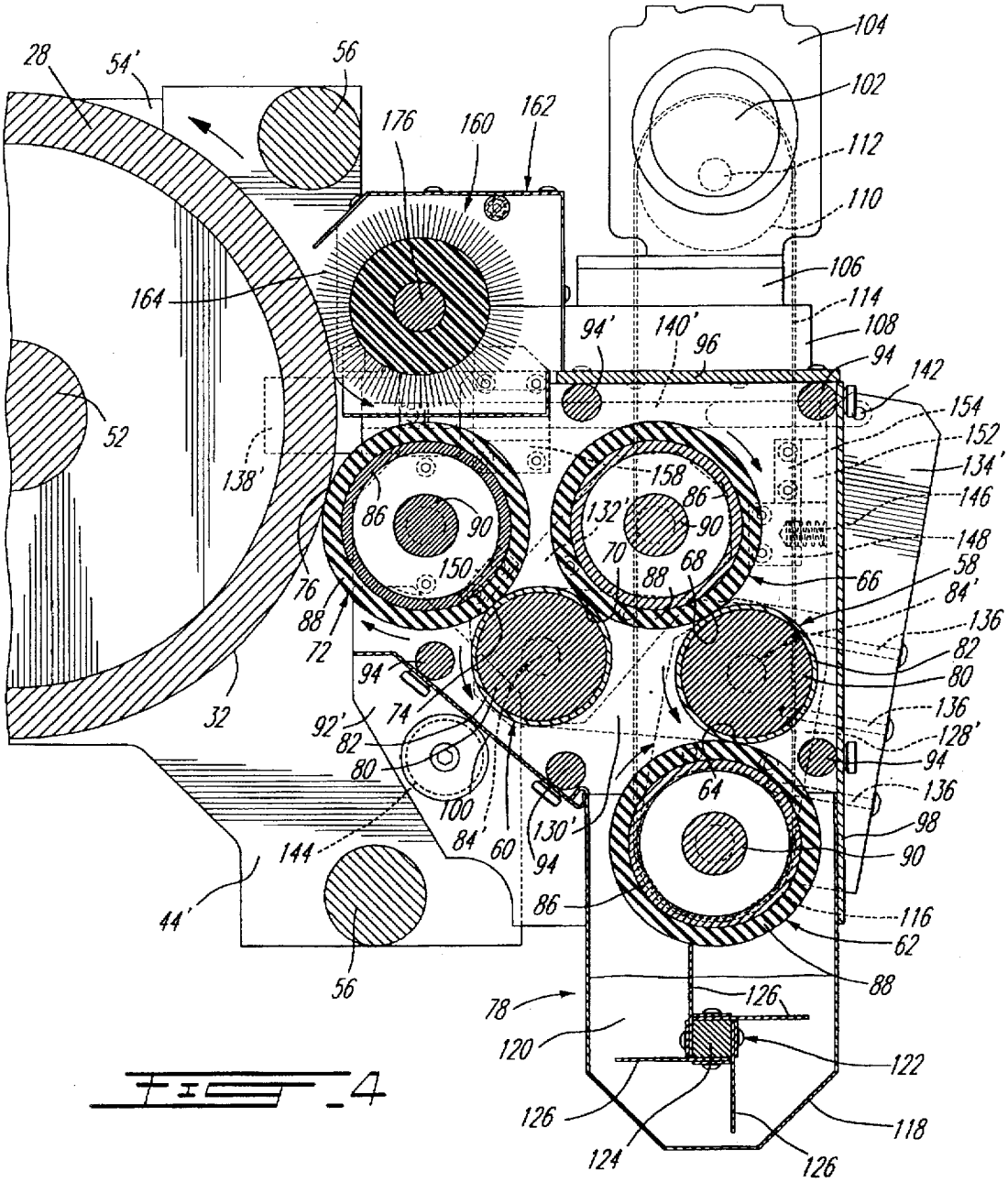
FIG. 4 is a fragmentary sectional view of the coating device shown in FIG. 3.
Figure 6:
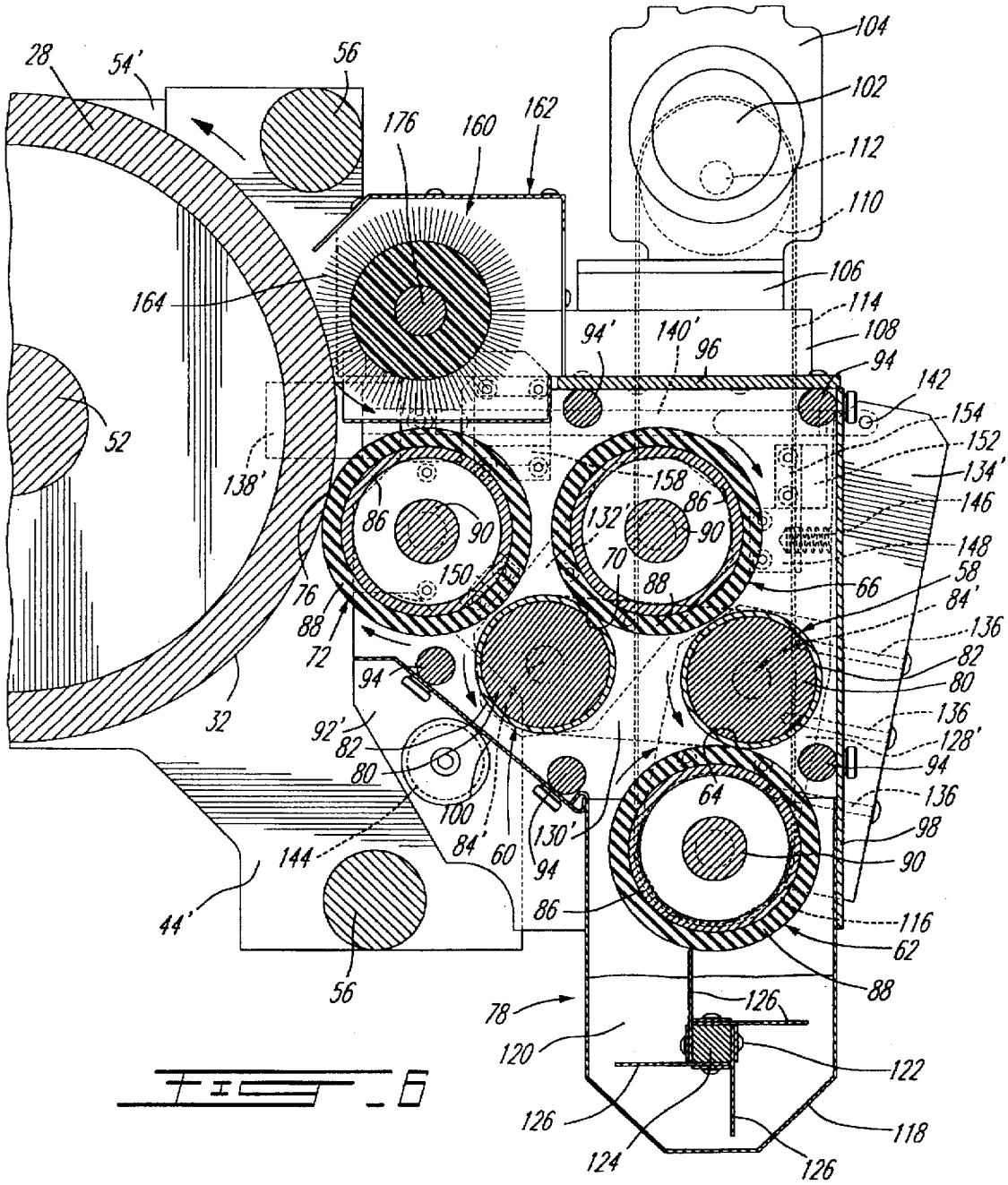
FIG. 6 is a fragmentary sectional view of the coating device shown in FIG. 5.

The applicator roller 62 is rotated by means of a motor 102 and gearbox 104 which are mounted on support blocks 106 and 108 fixed to the top plate 96. As shown in FIGS. 4 and 6, a sprocket 110 keyed to the drive shaft 112 is connected by a chain 114 to a sprocket 116 keyed to the shaft 90 of roller 62. The stub shafts 84,84' of roller 58 and the shafts 90 of rollers 62 and 66 are interconnected by gears (not shown). Thus, the rollers 58, 62 and 66 rotate in register. The drive from motor 102 which rotates the sprocket 110 in a clockwise manner transmits a clockwise rotation to the applicator roller 62 which in turn transmits a counterclockwise rotation to the distribution roller 58, the latter transmitting a clockwise rotation to the transfer roller 66.

The feed system 78 comprises a receptacle 118 mounted to the rear and bottom plates 98,100 for containing a bath 120 of olefinic substance in which the metal oxide is dispersed. A feed roller 122 is rotatably mounted within receptacle 118. As shown in FIGS. 4 and 6, the feed roller 122 has a shaft 124 provided with a plurality of elongated paddle members 126 of L-shaped cross-section extending longitudinally of the shaft 124 and arranged in spaced-apart relationship thereabout. The paddle members 126 which are formed of an oil-resistant synthetic rubber material such as a nitride are adapted to be at least partially immersed in the bath 120 so as to become coated with oily dispersion, and to successively contact the applicator roller 62 during rotation of the feed roller 122 so as to transfer the oily dispersion onto the roller 62. The feed roller 122 and applicator roller 62 are rotated in register by means of gears (not shown) interconnecting the shafts 90 and 124.

The oily dispersion is carried to the nip 64 by the applicator roller 66 during rotation thereof. The dispersion upon passing through the nip 64 forms a film uniformly covering the surface of the ceramic coating 82 of the distribution roller 58, the film breaking down into micro-droplets containing the olefinic substance in admixture with the metal oxide and having substantially uniform size and distribution. Should the film of oily dispersion only partially break down into the desired micro-droplets, any partially broken film of oily dispersion formed on the surface of the ceramic coating 82 of the distribution roller 58 is transferred from the roller 58 to the transfer roller 66 at the nip 68 and thereafter transferred from the roller 66 to the distribution roller 60 at the nip 70, the film substantially completely breaking down on the surface of the ceramic coating 82 of the roller 60 into the desired micro-droplets having substantially uniform size and distribution. The micro-droplets of olefinic substance containing the metal oxide are then transferred from the roller 60 to the transfer roller 72 at the nip 74 and thereafter transferred from the roller 72 to the positive electrode 28 at the nip 76. By varying the speed of rotation of the motor 102, one can vary the quantity of oily dispersion supplied to the applicator roller 62 and the number of micro-droplets ultimately transferred onto the positive electrode 28.

Figure 3:
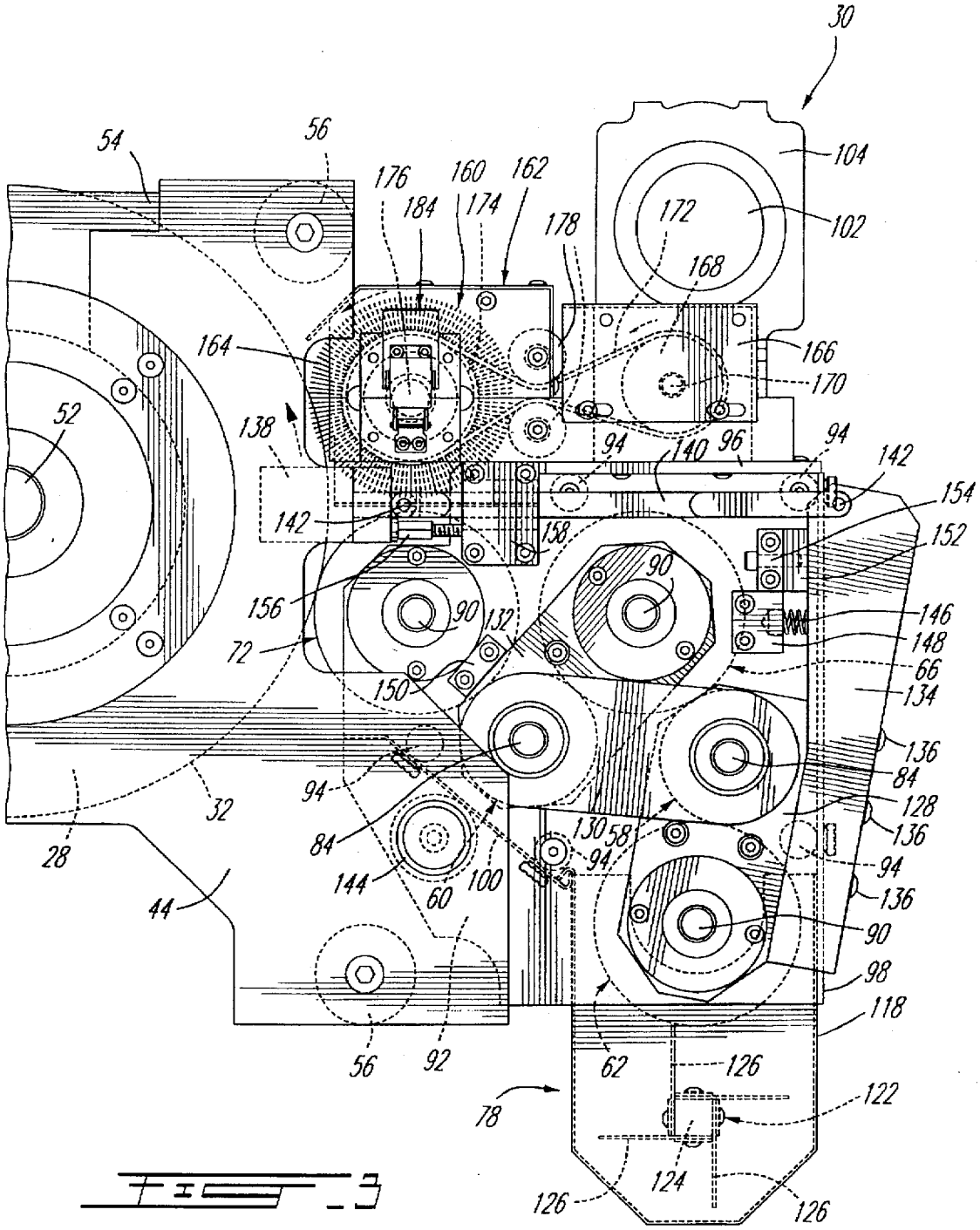
FIG. 3 is a fragmentary side view of the printing unit shown in FIG. 2, illustrating the coating device used for coating the positive electrode with an olefinic substance and a metal oxide.
Figure 5:
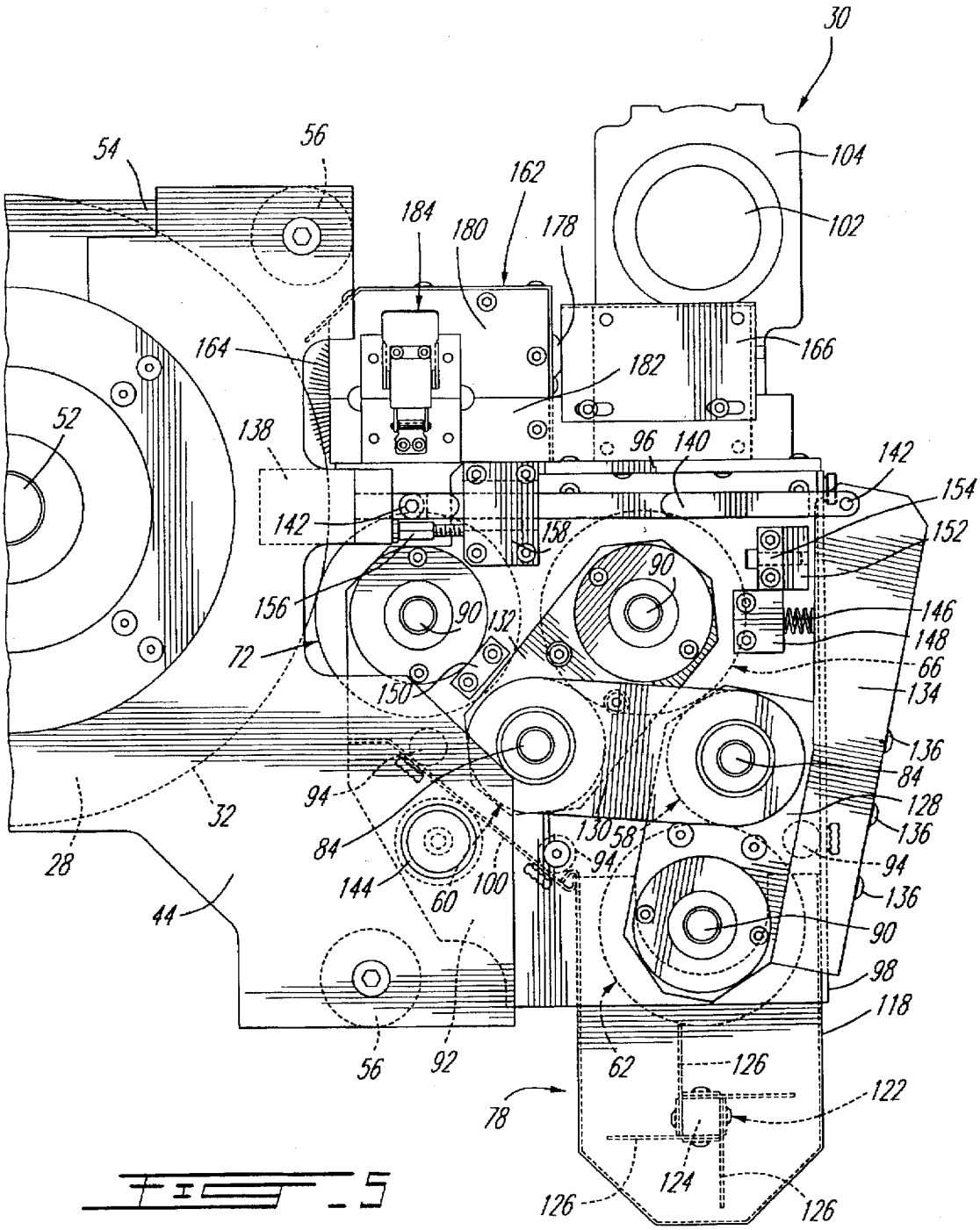
FIG. 5 is a view similar to FIG. 3, but illustrating a different position of the rollers of the coating device.

The distribution rollers 58,60 are movable between a working position illustrated in FIGS. 3 and 4, whereat the rollers 58 and 60 are in the aforesaid engagement with the transfer rollers 66 and 72, respectively, and a non-working position illustrated in FIGS. 5 and 6, whereat the rollers 58 and 60 are disengaged from the rollers 66 and 72, respectively. As shown, a first pair of opposite elongated arms 128,128' interconnect the stub shafts 84,84' of distribution roller 58 and the shaft 90 of applicator roller 62, the arms 128 and 128' being pivotally connected at one end thereof respectively to the stub shafts 84 and 84' and at the other end to the shaft 90 for pivotal movement about shaft 90. A second pair of opposite elongated arms 130,130' interconnect the stub shafts 84,84' of distribution roller 58 and the stub shafts 84,84' of distribution roller 60, the arms 130 and 130' being pivotally connected at one end thereof respectively to the stub shaft 84 and 84' of roller 58 and at the other end to the stub shafts 84 and 84' of roller 60. A third pair of opposite elongated arms 132,132' interconnect the stub shafts 84,84' of distribution roller 60 and the shaft 90 of transfer roller 66, the arms 132 and 132' being pivotally connected at one end thereof respectively to the stub shafts 84 and 84' of roller 60 and at the other end to the shaft 90 of roller 66 for pivotal movement about shaft 90. Two opposite elongated actuator arms 134 and 134' are fixed at one end thereof respectively to the arms 128 and 128' by bolts 136. Two hydraulic cylinders 138,138' mounted respectively on plates 44 and 44' are provided for pivotally moving the arms 134,134' and thus arms 128,128' about the shaft 90 of applicator roller 62, two elongated link members 140 and 140' being connected respectively between the other ends of arms 134,134' and the pistons of cylinders 138,138' by pivot pins 142. Actuation of the hydraulic cylinders 138,138' to move the actuator arms 134,134' by means of link members 140,140' in a direction away from the positive electrode 28 causes the arms 128,128' and 132,132' to pivotally move respectively about the shafts 90 of rollers 62 and 66 in directions away from the rollers 66 and 72, thereby moving the distribution rollers 58 and 60 from the working position illustrated in FIGS. 3 and 4 to the non-working position illustrated in FIGS. 5 and 6.

The plates 92 and 92' are pivotally connected respectively to the plates 44 and 44' by pivot pins 144, for pivotal movement about a pivot axis coincident with the pivot pins 144 and extending parallel to the rotation axis of the positive electrode 28. The plates 92,92' and rollers 58,60,62,66,70 are disposed relative to the pivot axis defined by the pivot pins 144 to provide a weight distribution such as to cause the plates 92,92' to pivotally move away from the positive electrode 28 when the actuator arms 134,134' and link members 140,140' are moved by the hydraulic cylinders 138,138' in the aforesaid direction. Thus, when the distribution rollers 58,60 are moved to the non-working position, the transfer roller 72 is moved from the working position illustrated in FIGS. 3 and 4, whereat the roller 72 is in the aforesaid engagement with the positive electrode 28, to a non-working position illustrated in FIG. 7, whereat the roller 72 is disengaged from the electrode 28. Two springs 146 each mounted to a spring-retaining member 148 fixed to a respective plate 92,92' engage the actuator arms 134,134' when the transfer roller 72 is in the non-working position so as to maintain the distribution rollers 58,60 in the non-working position.

Figure 7:
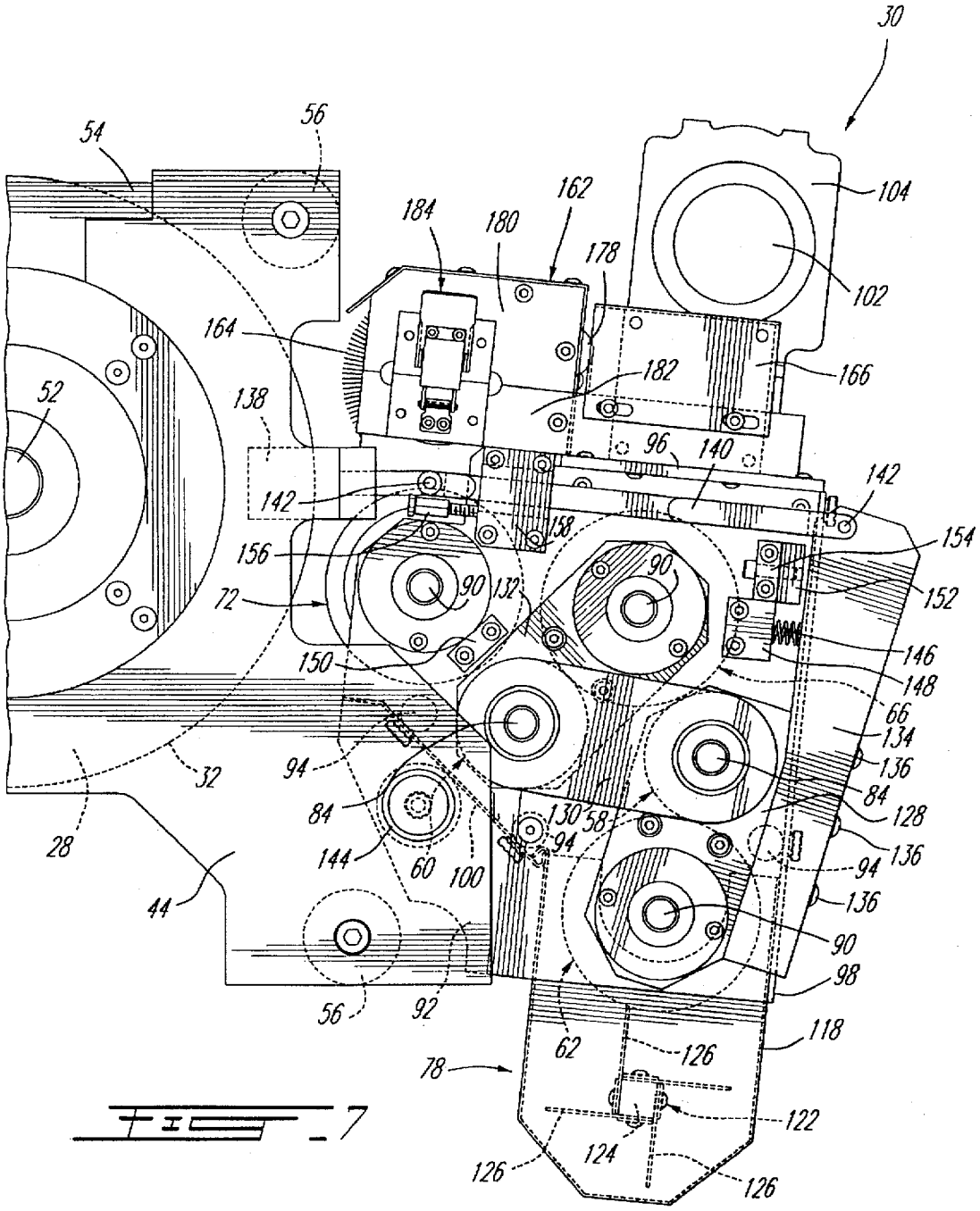
FIG. 7 is a view similar to FIG. 3, but illustrating the coating device in a non-working position.

Actuation of the hydraulic cylinders 138,138' to move the actuator arms 134,134' by means of link members 140,140' in a direction towards the positive electrode 28 causes the arms 128,128' and 132,132' to pivotally move respectively about the shafts 90 of rollers 62 and 66 in directions towards the rollers 66 and 72, thereby moving the distribution rollers 58 and 60 from the non-working position illustrated in FIGS. 5–7 to the working position illustrated in FIGS. 3 and 4. Two stop members 150 each mounted on plate 92,92' are provided for arresting the arms 132,132' and thus arms 128,128' when the rollers 58,60 are moved to the working position so as to limit the pressures exerted at nips 68,74 to predetermined values. Two abutment members 152 each mounted to an attachment member 154 fixed to a respective plate 92,92' are provided for engaging the actuator arms 134,134' when these are moved in the aforesaid direction by the hydraulic cylinders 138,138' and link members 140,140'. As the arms 134,134' abut against the abutment members 152, they pivotally move the plates 92,92' about the pivot axis defined by the pivot pins 144 in a direction towards the positive electrode 28, thereby moving the transfer roller 72 from the non-working position illustrated in FIG. 7 to the working position illustrated in FIGS. 3 and 4. Two stop members 156 (only one shown) each mounted to an attachment member 158 fixed to a respective plate 92,92' are also provided for engaging the plates 44,44' when the transfer roller 72 is moved to the working position so as to limit the pressure exerted at the nip 76 to a predetermined value. The link members 140,140' extend through slots formed in the attachment members 158.

By moving the distribution rollers 58,60 and transfer roller 72 to the aforesaid non-working positions, one can prevent the formation of flat spots in the polyurethane coverings 88 of rollers 66 and 72 when the printing units 20 are not in service for a long period of time, for example during storage or shipping. On the other hand, since the polyurethane covering 88 of the applicator roller 62 has a Shore A hardness of about 35–45, there is no need to disengage the rollers 58 and 62 from one another.

An elongated rotatable brush 160 mounted within a housing 162 on top of the coating device 30 and extending parallel to the rotation axis of the positive electrode 28 is provided for polishing the olefin and metal oxide-coated surface 32 of the electrode 28. The brush 160 has a plurality of radially extending bristles 164 made of horsehair and contacting the surface 32, and is rotated by means of a motor (not shown) mounted to a support plate 166. As shown in FIG. 3, a pulley 168 keyed to the drive shaft 170 is connected by a belt 172 to a pulley 174 keyed to the shaft 176 of brush 160. The brush 160 is rotated in a direction opposite to the direction of rotation of the electrode 28. Two tension rollers 178 are provided for tensioning the belt 172. The friction caused by the bristles 164 contacting the surface 32 upon rotation of the brush 160 has been found to increase the adherence of the micro-droplets of olefinic substance containing the metal oxide onto the positive electrode surface 32. As best shown in FIGS. 5 and 7, the housing 162 is a two-part housing including an upper part 180 defining a cover and a lower part 182, the cover 180 being releasably secured to the lower part 182 by two releasable locking devices 184 (only one shown) comprising a strike and catch mechanism. Since the housing 162 with the brush 160 therein is mounted on top of the coating device 30, the brush 160 is movable with the plates 92,92' between a working position illustrated in FIGS. 3 and 4, whereat the bristles 164 are in frictional contact engagement with the positive electrode surface 32, and a non-working position illustrated in FIG. 7, whereat the bristles 164 are disengaged from the surface 32, when the transfer roller 72 is moved between the aforesaid working and non-working positions.

Figure 9:
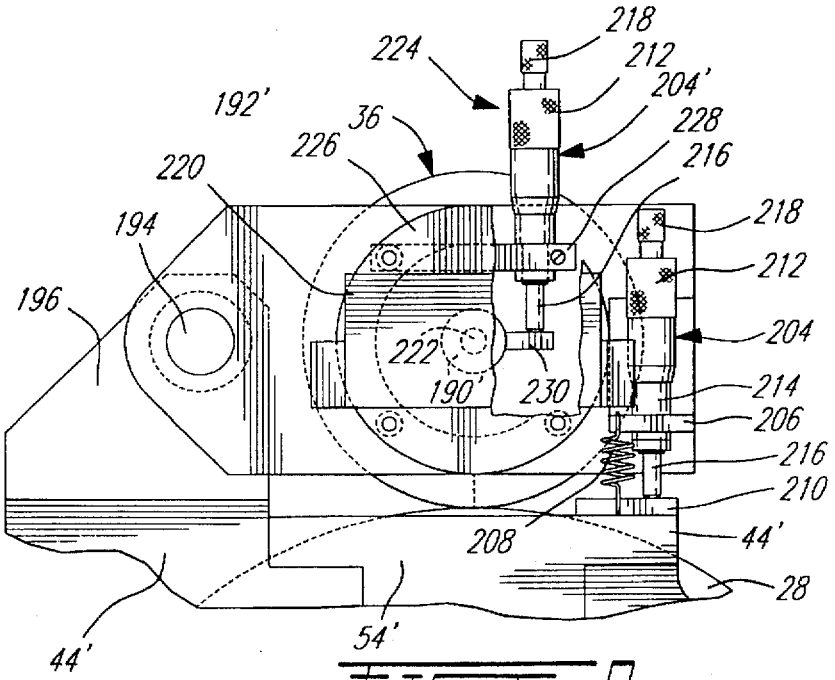
FIG. 9 is a fragmentary side elevational view of the printing unit shown in FIG. 2, illustrating details of the printing head.
Figure 10:
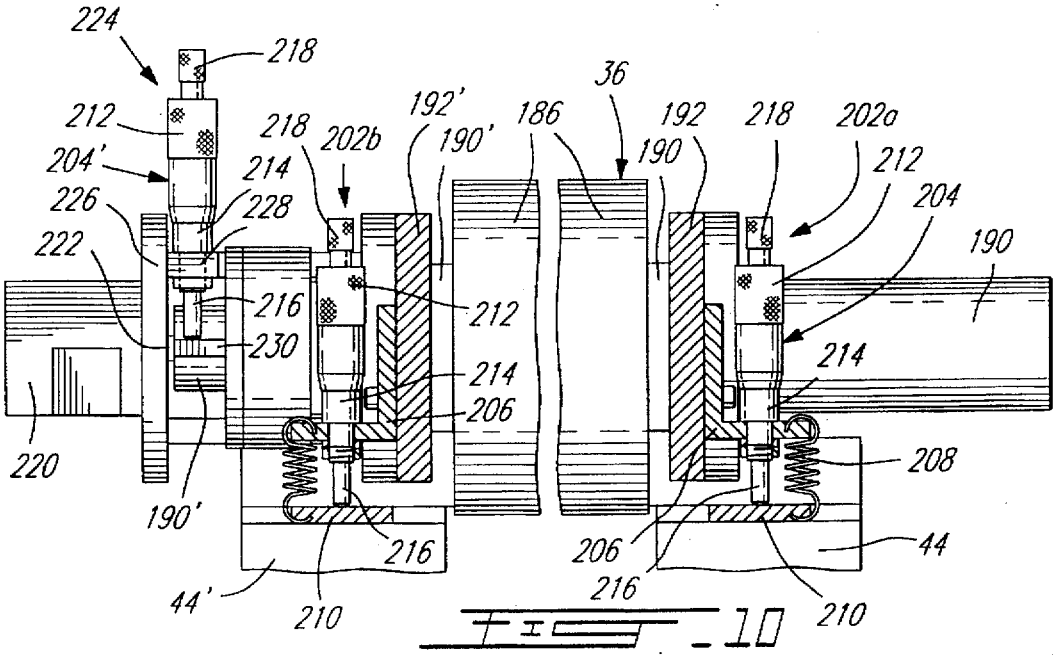
FIG. 10 is a fragmentary sectional front view of the printing unit shown in FIG. 2, illustrating further details of the printing head.
Figure 11:
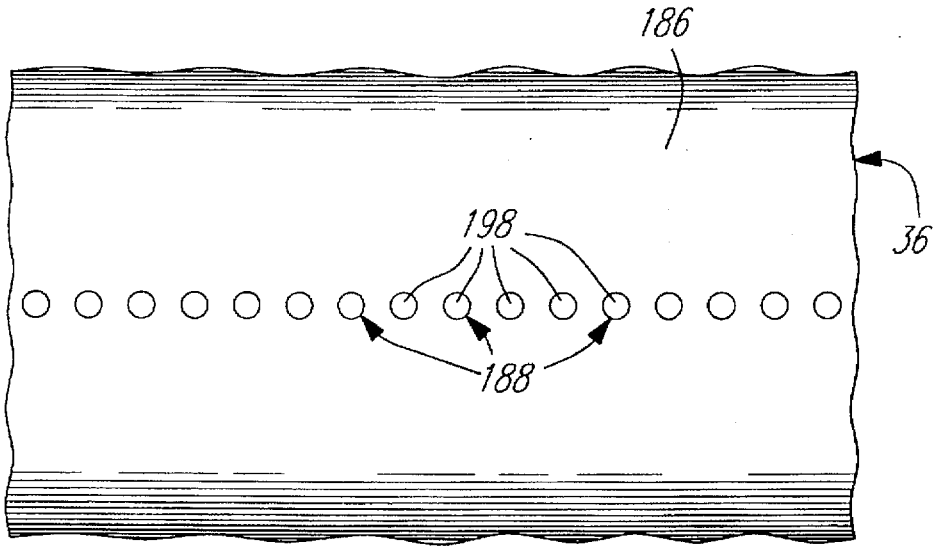
FIG. 11 is a fragmentary longitudinal view of the printing head shown in FIGS. 9 and 10.

As shown in FIGS. 8–11, the printing head 36 comprises a cylindrical body 186 provided with a plurality of negative electrodes 188 and a pair of cylindrical projections 190,190' extending outwardly from the extremities of the body 186 and defining stub shafts. The body 186 is rotatably mounted between a pair of opposite elongated arms 192,192' which are pivotally connected by pivot pins 194 to brackets 196 fixed to plates 44,44', for pivotal movement of the arms 192,192' about a pivot axis coincident with the pivot pins 194 and extending parallel to the rotation axis of the positive electrode 28. The negative electrodes 188 are electrically insulated from one another and arranged in rectilinear alignment along the length of the body 186 to define a series of corresponding negative electrode active surfaces 198, as best shown in FIG. 11. In the operative position illustrated in FIGS. 8 and 8A, the printing head is positioned relative to the positive electrode 28 such that the surfaces 198 of the negative electrodes 188 are in a plane parallel to the rotation axis of the electrode 28 and are spaced from the positive electrode surface 32 by a constant predetermined gap 200, the plane being also parallel to a plane extending tangentially to the surface 32 at the gap 200. The electrodes 188 are also spaced from one another by a distance at least equal to the electrode gap 200 to prevent edge corrosion of the negative electrodes.

Two separate gap adjustment systems **202*a*,202*b* associated respectively with the arms 192,192' are provided for adjustably varying the gap 200. The gap adjustment systems 202*a*,202*b* are identical to one another and are illustrated in FIG. 10. As shown, the system 202*a* includes a micrometer head 204 which is fixedly mounted to the arm 192 by an L-shaped bracket 206. A spring 208 is connected between the bracket 206 and an abutment member 210 fixed to plate 44 (and to plate 44' in the case of system 202*b*) for biasing the arm 192 (and the arm 192' in the case of system 202*b*) in a direction towards the positive electrode 28. The micrometer head 204 comprises a thimble 212 which is rotatably mounted on a sleeve 214 for axially moving a spindle 216 outwardly or inwardly of the sleeve 214. The spindle 216 is adapted to abut against the abutment member 210. Thus, by rotating the thimble 212 of each micrometer head 204 to adjustably move the spindle 216 in abutting contact engagement with the number 210, one can adjustably pivot the arms 192,192' with the body 186 of printing head 36 therebetween in a direction towards or away from the positive electrode 28 to thereby adjustably vary the gap 200. The micrometer head 204 is provided with spindle lock 218 to lock the spindle 216 at a predetermined length and thereby retain the printing head 36 in a selected position relative to the electrode 28**.

As shown in FIGS. 9 and 10, a step-motor 220 is provided for rotating the printing head 36 about a rotation axis coincident with the stub shafts 190,190' between the aforesaid operative position and a cleaning position (not shown) whereat the negative electrode surfaces 198 are exposed to permit cleaning thereof. The drive shaft 222 of motor 220 is connected to the stub shaft 190'. A tilt adjustment system 224 is also provided for adjusting the angular position of the negative electrodes 188 relative to a plane intersecting the rotation axes of the positive electrode 28 and printing head 36. The system 224 comprises a micrometer head 204' which is identical to the micrometer 204, but which is fixedly mounted to the flange 226 of motor 220 by a bracket 228. The spindle 216 of the micrometer head 204' is adapted to abut against an abutment member 230 fixed to the stub shaft 190'. Thus, by rotating the thimble 212 of micrometer head 204' to adjustably move the spindle 216 in abutting contact engagement with the member 230, one can adjustably rotate the printing head 36 so that the angular position of the negative electrodes 188 relative to the aforesaid plane defines a 0° angle, that is, the electrodes 188 are disposed in such a plane. The spindle lock 218 of micrometer head 204' is then rotated to lock the spindle 216 at a predetermined length and thereby retain the printing head 36 in the desired rotational position.

Figure 8:
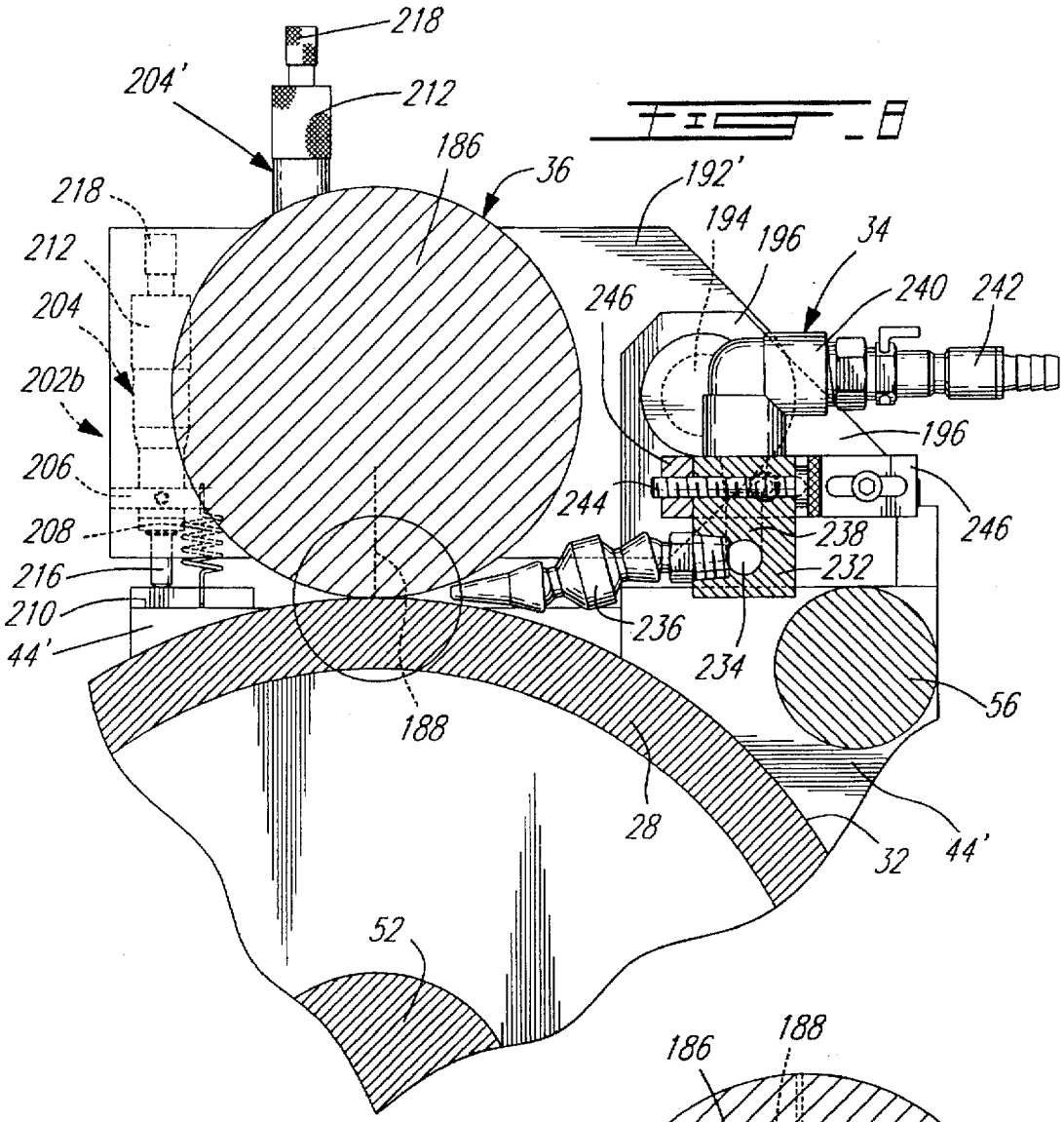
FIG. 8 is a fragmentary sectional view of the printing unit shown in FIG. 2, illustrating the printing head and associated colloid injector used for the colloid electrocoagulation.
Figure 8A:
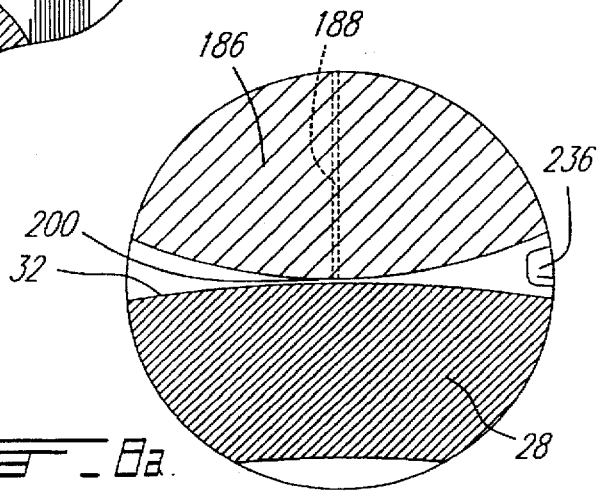
FIG. 8A is an enlarged, fragmentary sectional view of the portion encircled in FIG. 8.

The colloid injector 34 is adapted to fill the electrode gap 200 with a colloidal dispersion containing an electrolytically coagulatable colloid, a dispersing medium, a soluble electrolyte and a coloring agent. As shown in FIG. 8, the injector 34 comprises an elongated injector block 232 provided with an elongated conduit 234 extending longitudinally of the block 232 and two spaced-apart nozzles 236 (only one shown) in fluid communication with the conduit 234 which in turn is in fluid communication via a transversely extending conduit 238 with an elbow pipe 240 connected to a valved inlet connector 242 adapted for connection to a feed tube (not shown). The injector block 232 is fixed by means of screws members 244 (only one shown) to an elongated U-shaped support member 246 which is mounted between the brackets 196. The nozzles 236 are adapted to discharge the colloidal dispersion in the form of jets in a direction substantially tangent to the surface 32 of the positive electrode 28.

Electrical energizing of selected ones of the negative electrodes 188 causes point-by-point selective coagulation and adherence of the colloid onto the olefin and metal oxide-coated surface 32 of the positive electrode 28 opposite the electrode active surfaces 198 of the energized negative electrodes 188 while the electrode 28 is rotating, thereby forming a series of corresponding dots of colored, coagulated colloid representative of a desired image. The optical density of the dots of colored, coagulated colloid may be varied by varying the voltage and/or pulse duration of the pulse-modulated signals applied to the negative electrodes 188. Synchronization of the data furnished to the printing heads of the four printing units 20 is ensured by proper electronic circuitry (not shown).

Figure 12:
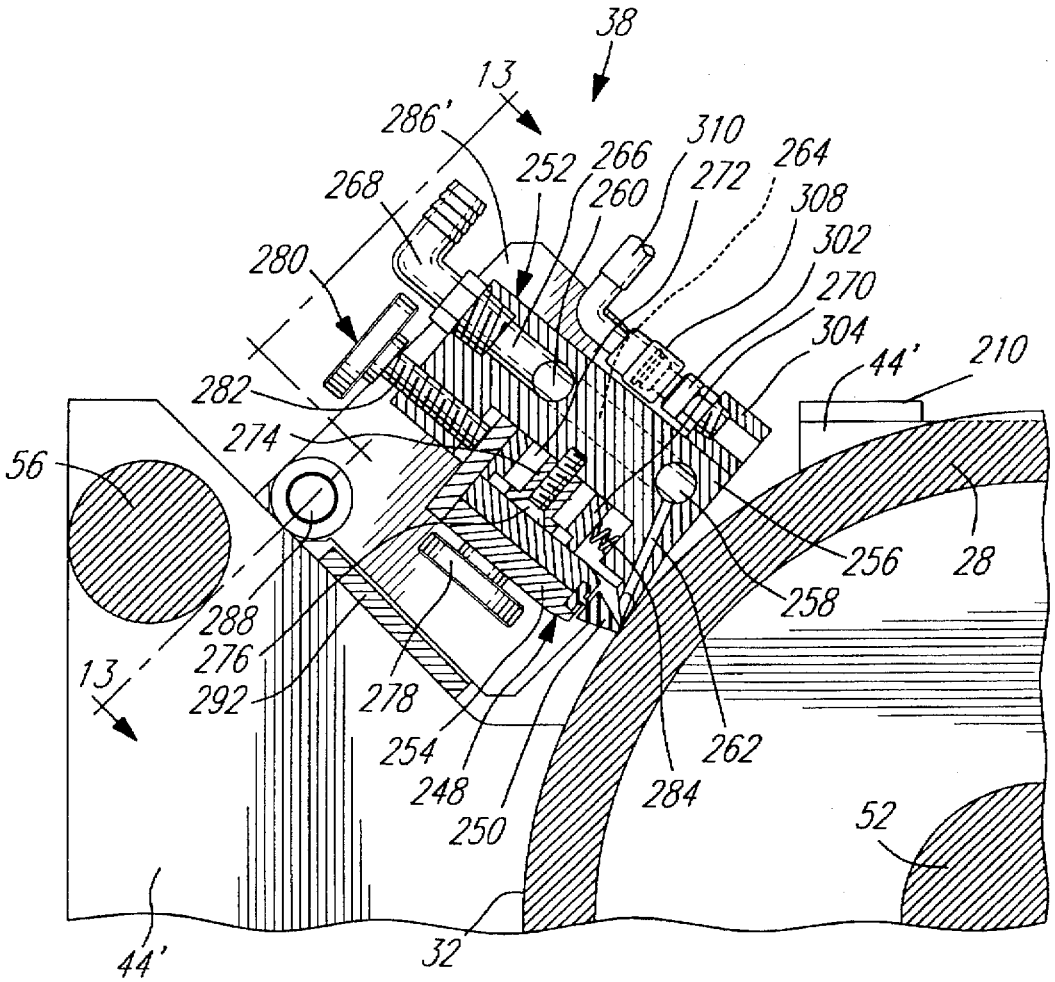
FIG. 12 is a fragmentary sectional view of the printing unit shown in FIG. 2, illustrating the device used for removing non-coagulated colloid remaining on the surface of the positive electrode.
Figure 13:
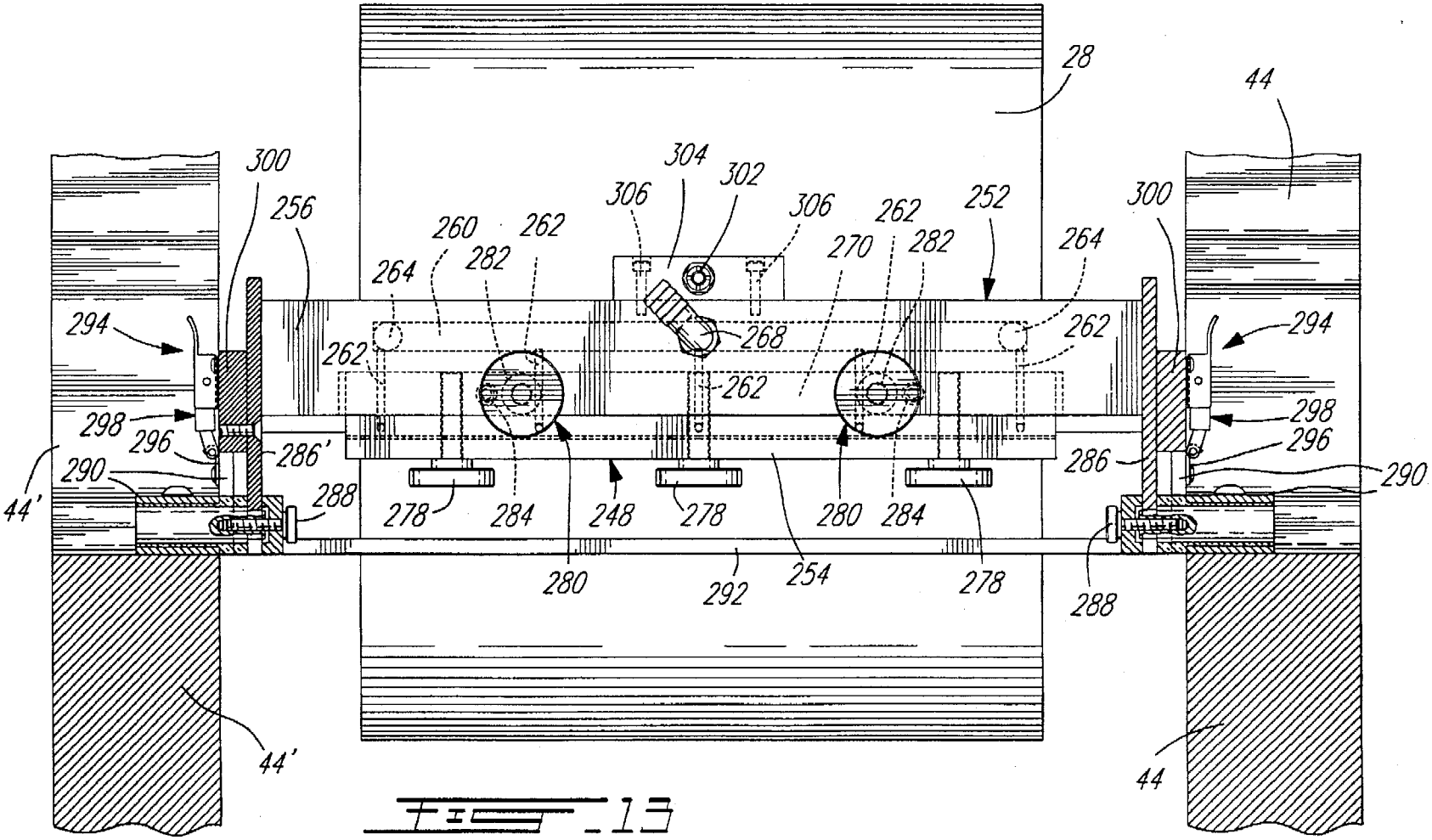
FIG. 13 is a sectional view taken along line 13—13 of FIG. 12.

The device 38 is adapted to remove from the positive electrode surface 32 excess colloidal dispersion flowing through the gap 200 and carried by the positive electrode 28 during rotation thereof. As shown in FIGS. 12 and 13, the device 38 comprises a squeegee 248 having an elongated blade member 250 of resilient material extending parallel to the rotation axis of the electrode 28 and in pressure contact engagement with the surface 32 thereof for retaining upstream of the squeegee 248 the excess colloidal dispersion, and a suction head 252 for sucking up the excess colloidal dispersion retained by the blade member 250. The blade member 250 is fixed to an elongated support member 254 of L-shaped cross-section. The suction head 252 comprises an elongated body 256 provided with two main conduits 258,260 extending longitudinally of the body 256, a plurality of transversely extending, spaced-apart parallel secondary conduits 262 opening closely adjacent the blade member 250 and in fluid communication with the conduit 258, two intermediate conduits 264 providing fluid communication between conduits 258 and 260, and an outlet conduit 266 providing fluid communication between conduit 260 and an elbow pipe 268 adapted for connection to a suction pump (not shown). The squeegee 248 is displaceably mounted to the body 256 of the suction head 252 for movement in a direction towards or away from the positive electrode 28. As shown, an attachment member 270 provided with two guide slots 272 (only one shown) is slidably mounted to the body 256 by means of guide members 274 extending through the slots 272 and fixed to the body 256 by screws 276. The support member 254 of squeegee 248 is removably fixed to the attachment member 270 by three removable screw members 278. Two adjustable screw members 280 each having a stem 282 threadedly engaged with the body 256 and contacting the support member 254 are provided for adjustably moving the squeegee 248 towards or away from the positive electrode 28, the support member 254 being retained in contact engagement with the stems 282 of screw members 280 by means of two springs 284 engaging the attachment member 270 so as to urge the member 254 against the stems 282.

The body 256 of suction head 252 is mounted between a pair of opposite vertical plates 286,286' (plate 286 being shown in FIG. 2) which are pivotally connected by pivot pins 288 to brackets 290 fixed to plates 44,44', for pivotal movement of the device 38 in a direction towards or away from the positive electrode 28, between the working position illustrated in FIG. 12, whereat the blade member 250 is in the aforesaid engagement with the positive electrode 28, and a non-working position (not shown) whereat the blade member 250 is disengaged from the electrode 28. In the working position, the plates 286,286' abuts against an elongated abutment plate 292 which is integral with the brackets 290. Two releasable locking devices 294 comprising a strike and catch mechanism are provided for releasably securing the plates 286,286' to the brackets 290 when the device 38 is in the working position, thereby immobilizing the suction head 252. The strike members 296 are fixedly mounted to the brackets 290, whereas the catch members 298 are fixedly mounted to spacer members 300 fixed to the plates 286,286'. Thus, but rotating the screw members 280 to move the squeegee 248 towards or away from the positive electrode 28, one can adjustably vary the pressure exerted by the blade member 250 against the surface 32 of the electrode 28.

The excess colloidal dispersion retained by the blade member 250 and sucked up by the suction head 252 is collected in a reservoir (not shown) and the collected colloidal dispersion is recirculated back to the injector 34 by means of a recirculation system including a pump (not shown). A colloid drip member 302 mounted to an attachment member 304 fixed by screws 306 to the body 256 of suction head 252 is provided for adding fresh colloidal dispersion to the excess colloidal dispersion upstream of the blade member 250. The drip member 302 is provided with a quick connector 308 for connection to a feed tube 310. The added fresh colloidal dispersion is mixed with the excess colloidal dispersion during removal by the device 38 and recirculation to the colloid injector 34.

Figure 14:
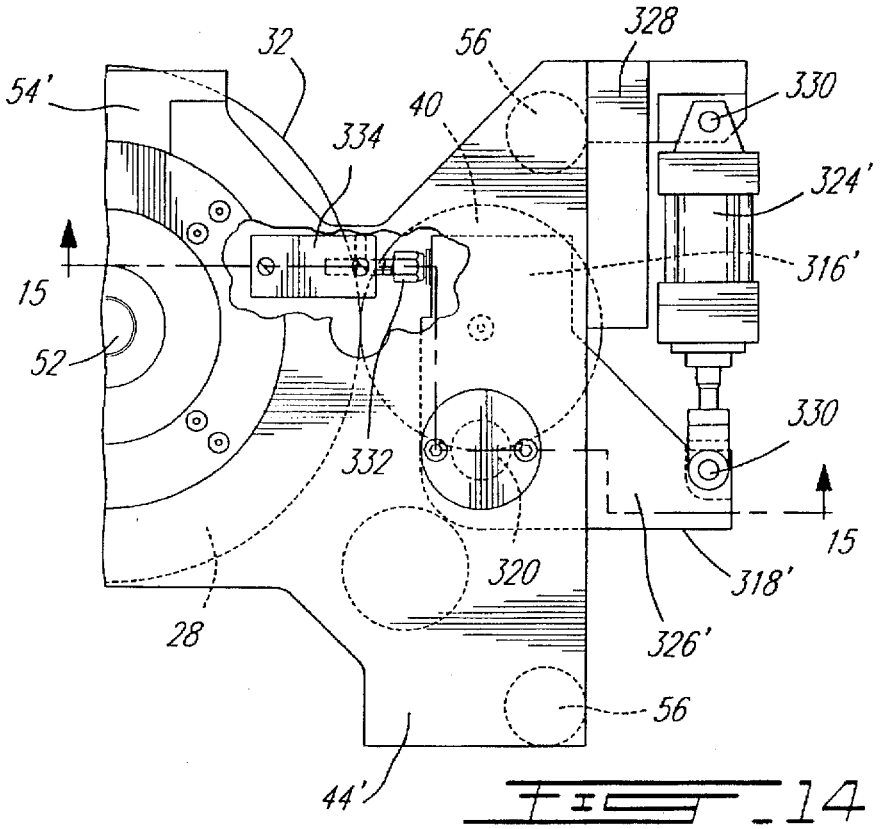
FIG. 14 is a fragmentary side elevational view of the printing unit shown in FIG. 2, illustrating the pressure roller used for transferring the colored, coagulated colloid onto a web.
Figure 15:
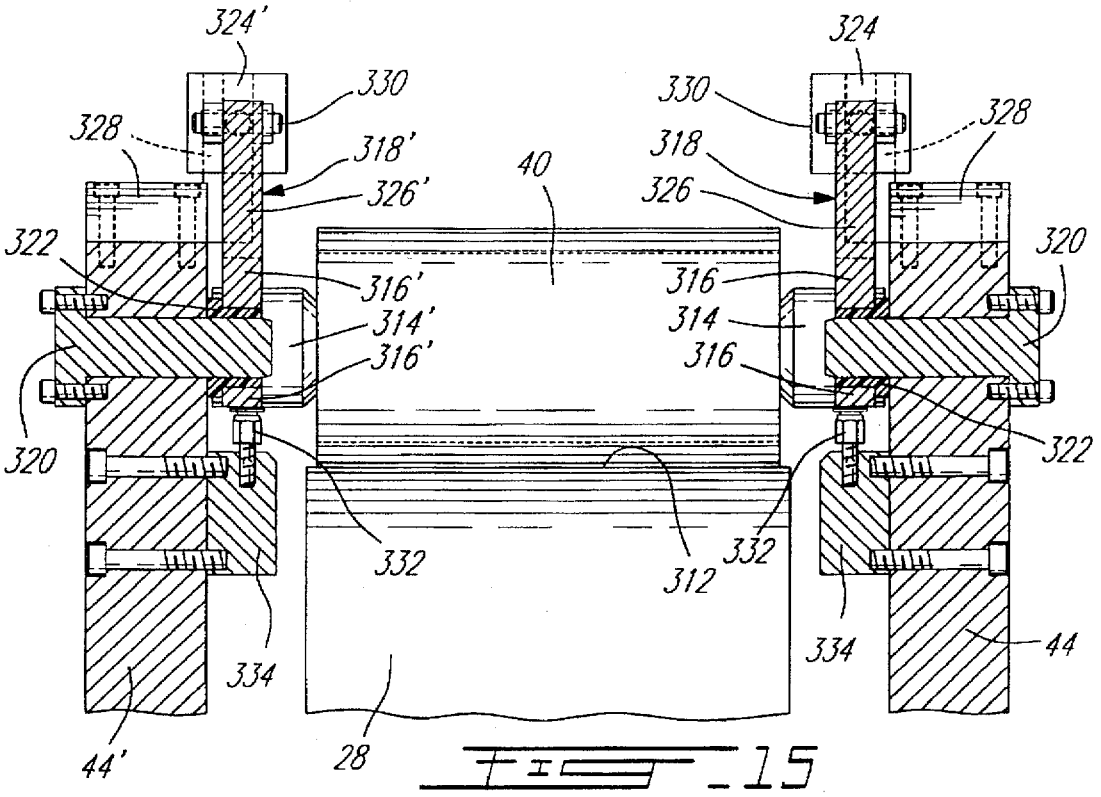
FIG. 15 is a sectional view taken along line 15—15 of FIG. 14.
Figure 18:
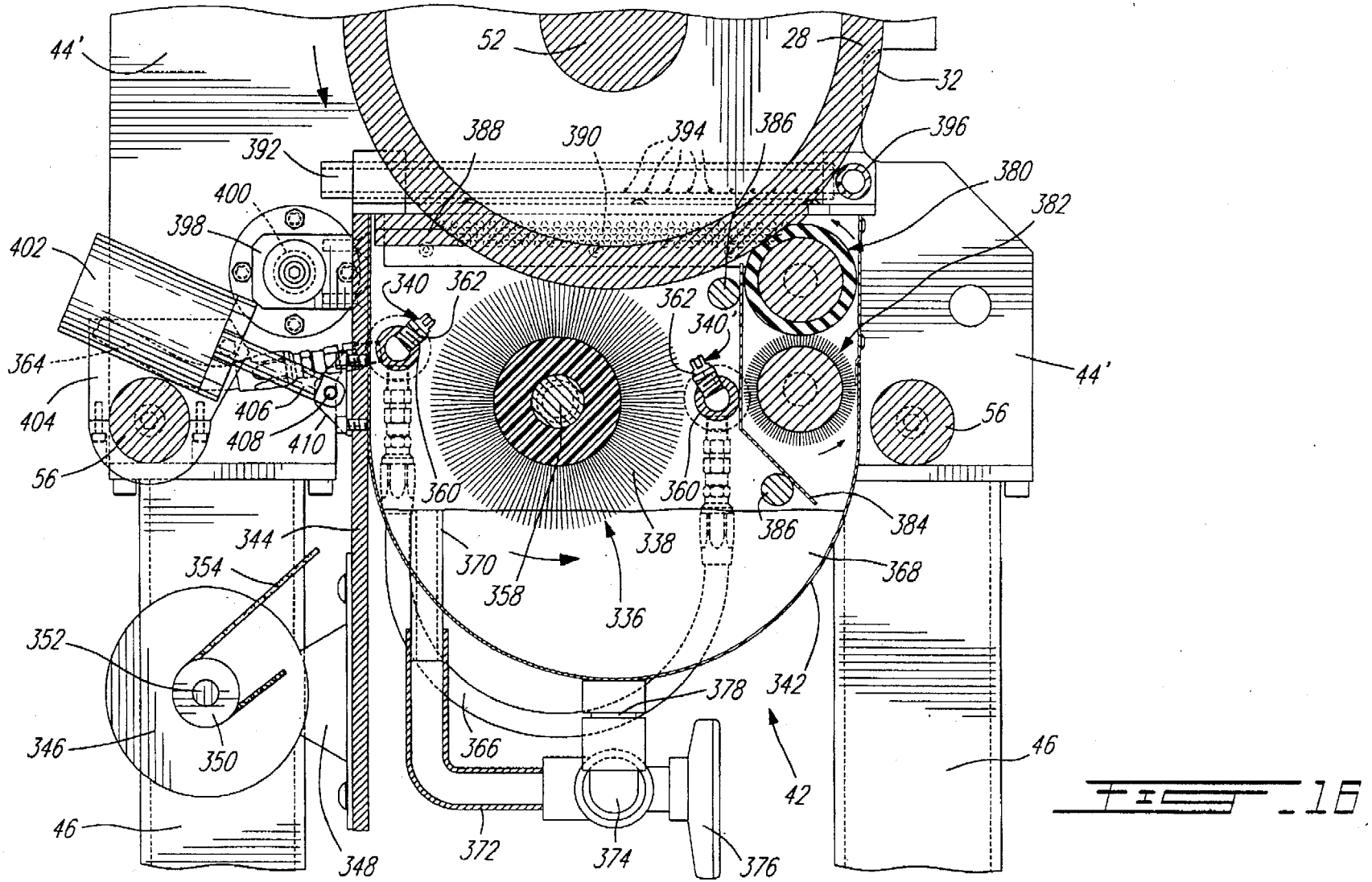

The device 38 enables the dots of colored, coagulated colloid adhered on the surface 32 and representative of a desired image to be fully uncovered for transfer onto the web 22 (shown in FIG. 1). As shown in FIGS. 14 and 15, the pressure roller 40 which serves to bring the web into contact with the dots of colored, coagulated colloid is in pressure contact engagement with the positive electrode 28 to form a nip 312 through which the web is passed and to permit the roller 40 to be driven by the electrode 28 upon rotation thereof. As the web 22 is contacted with the dots of colored, coagulated colloid, the colored, coagulated colloid is transferred onto the web to thereby imprint same with the image. The pressure roller 40 which is provided with a pair of stub shafts 314,314' is rotatably mounted between the arms 316 and 316' of a pair of opposite bell cranks 318,318' which are pivotally connected respectively to plates 44,44' by means of pivot pins 320 and bushings 322. Two hydraulic cylinders 324,324' are connected respectively between the other arms 326,326' of the bell cranks 318,318' and L-shaped attachment members 328 by pivot pins 330, the attachment members 328 being fixed to plates 44,44'. Actuation of the hydraulic cylinders 324,324' causes the arms 316,316' with the roller 40 therebetween to pivotally move in a direction towards or away from the positive electrode 28, between the working position illustrated in FIGS. 14 and 15, whereat the pressure roller is in the aforesaid engagement with the electrode 28, and a non-working position (not shown) whereat the roller 40 is disengaged from the electrode 28. Two stop members 332 each mounted to an attachment member 334 fixed to a respective plate 44,44' are provided for arresting the arms 316,316' when the pressure roller 40 is moved to the working position, so as to limit the pressure exerted at the nip 312 to a predetermined value.

After transfer of the colored, coagulated colloid onto the web 22, any coagulated colloid remaining on the surface 32 of the positive electrode 28 is removed by the cleaning device 42. As shown in FIG. 16, the device 42 comprises an elongated rotable brush 336 extending parallel to the rotation axis of the electrode 28, the brush 336 being provided with a plurality of radially extending bristles 338 contacting the surface 32 of the electrode 28, and two high pressure water injectors 340,340' each disposed on either side of the brush 336. The brush 336 and water injectors 340 are arranged inside an elongated trough 342 fixed to a plate 344. The brush 336 is rotated by means of a motor 346 which fixedly mounted to the plate 344 by a bracket 348. A pulley 350 keyed to the drive shaft 352 of motor 346 is connected by a belt 354 to a pulley 356 (shown in FIG. 2) keyed to the shaft 358 of brush 336. The water injectors 140,140' each comprise a pipe 360 extending parallel to the rotation axis of the electrode 28 and provided with a plurality of spaced-apart nozzles 362 (only one shown) adapted to direct high pressure jets of water against the surface 32 of the electrode 28. The pipe 360 of injector 340 is connected to a feed tube 364 and is in fluid communication with the pipe 360 of injector 340' by means of tube 366. The brush 336 is rotated in a direction opposite to the direction of rotation of the positive electrode 28 so that the bristles 338 frictionally engage the surface 32 of the electrode 28. As shown, the bristles 338 are partially immersed in a bath of water 368 which is maintained at a predetermined level by means of an overflow pipe 370 which is connected by tube 372 to a valve 374 provided with a handle 376. The trough 342 is provided with a drain pipe 378 connected to the valve 374.

Excess water is removed from the surface 32 of the positive electrode 28 by means of a squeegee roller 380 which is rotated by a motor (not shown) in a direction opposite to the direction of rotation of the electrode 28, the surface of the roller 380 being continuously cleaned by a brush 382 rotating in a direction opposite to the direction of rotation of the roller 380. The roller 380 and brush 382 are separated from the brush 336 by a partition 384 which is fixed to rods 386 connected between the end walls of the trough 342. An elongated brush 388 arranged at each end of the electrode 28 and having bristles 390 contacting the end surface of the electrode is provided for removing excess water from the electrode end surfaces. An air pipe 392 arranged at each end of the electrode 28 and having a plurality of spaced-apart orifices 394 adapted to direct jets of air downwardly against the end surface of the electrode is also provided for evaporating any water remaining on the electrode end surfaces. The air pipes 392 are in fluid communication with another air pipe 396 extending parallel to the rotation axis of the electrode 28 and provided with similar orifices for directing jets of air downwardly against the surface 32 of the electrode, so as to evaporate any water remaining on the surface 32.

The plate 344 to which the trough 342 is fixed is pivotally connected to the plates 44,44' by means of brackets 398 and pivot pins 400. A hydraulic cylinder 402 is fixedly mounted on the brace 56 by a collar member 404, the piston 406 being connected by a pivot pin 408 to a bracket fixed to the plate 344. Thus, by actuating the cylinder 402, one can pivotally move the cleaning device 42 about a pivot axis coincident with the pivot pins 400, between the closed position illustrated in FIG. 16 and an opened position (not shown).

Since the cleaning device 42 is disposed under the position electrode 28 and below the coating device 30, any water leaking from the device 42 cannot contaminate the device 30. The water injectors 340,340' in the cleaning device 42 can thus be operated at high pressure without any risk of contaminating the coating device 30.

We claim:

1. An electrocoagulation printing apparatus comprising:

a positive cylindrical electrode having a central longitudinal axis extending horizontally and a passivated surface defining a positive electrode active surface, said positive electrode being formed of an electrolytically inert metal;

means for rotating said positive electrode about the longitudinal axis thereof at a substantially constant speed;

coating means for coating the positive electrode active surface with an olefinic substance and a metal oxide to form on said surface micro-droplets of olefinic substance containing the metal oxide;

means for forming on the olefin and metal oxide-coated positive electrode active surface a plurality of dots of colored, coagulated colloid by electrocoagulation of an electrolytically coagulable colloid together with a coloring agent, said dots of colored, coagulated colloid being representative of a desired image;

means for bringing a substrate into contact with the dots of colored, coagulated colloid to cause transfer of the colored, coagulated colloid from the positive electrode active surface onto said substrate and thereby imprint said substrate with said image; and cleaning means for cleaning said positive electrode active surface to remove therefrom any remaining coagulated colloid, said cleaning means being disposed under said positive electrode and below said coating means.

2. An apparatus as claimed in claim 1, wherein said coating means comprises first and second distribution rollers arranged in spaced-apart parallel relation to one another and to said positive electrode, said first and second distribution rollers each having a peripheral coating comprising an oxide ceramic material, applicator means for applying said olefinic substance in the form of an oily dispersion containing said metal oxide as dispersed phase onto the ceramic coating of said first distribution roller to form on a surface thereof a film of said oily dispersion uniformly covering the surface of said ceramic coating, said film of oily dispersion at least partially breaking down into micro-droplets containing said olefinic substance in admixture with said metal oxide and having substantially uniform size and distribution, first transfer means arranged between said first distribution roller and said second distribution roller for transferring the at least partially broken film from said first distribution to said second distribution roller so as to cause said film to substantially completely break on the ceramic coating of said second distribution roller into said micro-droplets having a substantially uniform size and distribution, and second transfer means arranged between said second distribution roller and said positive electrode for transferring said micro-droplets from the ceramic coating of said second distribution roller onto said positive electrode active surface.

3. An apparatus as claimed in claim 2, wherein the ceramic coatings of said first distribution roller and said second distribution roller comprise the same oxide ceramic material, and wherein said oxide ceramic material comprises a fused mixture of alumina and titania.

4. An apparatus as claimed in claim 2, wherein said applicator means comprises an applicator roller extending parallel to said first distribution roller and in pressure contact engagement therewith to form a first nip, means for rotating said applicator roller and said first distribution roller in register and feed means for supplying said oily dispersion to said applicator roller, so that said oily dispersion is carried to said first nip by said applicator roller during rotation thereof and upon passing through said first nip forms said film uniformly covering the surface of said ceramic coating.

5. An apparatus as claimed in claim 4, wherein said feed means comprises a receptacle for containing a bath of said oily dispersion, a feed roller extending parallel to said applicator roller, said feed roller having a plurality of elongated paddle members extending longitudinally thereof and each adapted to be at least partially immersed in said bath, said paddle members being arranged in spaced-apart relationship about said feed roller such that one of said paddle members is positioned to contact said applicator roller, and means for rotating said feed roller to move said one paddle member to a non-contact position with an adjacent paddle member coated with said oily dispersion being moved to contact said applicator roller so as to transfer thereon said oily dispersion.

6. An apparatus as claimed in claim 5, wherein said paddle members are adapted to agitate said bath during rotation of said feed roller so as to disperse said metal oxide in said olefinic substance and thereby form said oily dispersion.

7. An apparatus as claimed in claim 6, wherein said paddle members are formed of a resilient material which is resistant to attack by oil.

8. An apparatus as claimed in claim 7, wherein said resilient, oil-resistant material is a synthetic rubber material.

9. An apparatus as claimed in claim 8, wherein said synthetic rubber material comprises a nitride.

10. An apparatus as claimed in claim 4, wherein said first transfer means comprises a first transfer roller extending parallel to said first and second distribution rollers, in pressure contact engagement with said first distribution roller to form a second nip and in contact engagement with said second distribution roller to form a third nip, and means for rotating said first transfer roller and said first distribution roller in register, so that said at least partially broken film is transferred from said first distribution roller to said first transfer roller at said second nip and thereafter from said first transfer roller to said second distribution roller at said third nip.

11. An apparatus as claimed in claim 10, wherein said second transfer means comprises a second transfer roller extending parallel to said second distribution roller and in pressure contact engagement therewith to form a fourth nip, said second transfer roller being in pressure contact engagement with said positive electrode to form a fifth nip and permit said second transfer roller to be driven by said positive electrode and said second distribution roller to be driven by said second transfer roller upon rotation of said positive electrode, so that said micro-droplets are transferred from said second distribution roller to said second transfer roller at said fourth nip and thereafter from said second transfer roller to said positive electrode at said fifth nip.

12. An apparatus as claimed in claim 11, wherein said applicator roller, said first transfer roller and said second transfer roller are each provided with a peripheral covering of a resilient material which is resistant to attack by said olefinic substance.

13. An apparatus as claimed in claim 12, wherein said resilient, oil-resistant material is a synthetic rubber material.

14. An apparatus as claimed in claim 13, wherein said synthetic rubber material comprises a polyurethane.

15. An apparatus as claimed in claim 11, further including means for moving said first and second distribution rollers between a working position whereat said first distribution roller is in said engagement with said first transfer roller and said second distribution roller is in said engagement with said second transfer roller, and a non-working position whereat said first distribution roller is disengaged from said first transfer roller and said second distribution roller is disengaged from said second transfer roller.

16. An apparatus as claimed in claim 15, wherein said applicator roller, said first and second distribution rollers and said first transfer rollers have respectively first, second, third and fourth central longitudinally extending shafts and are mounted between opposite vertically extending first and second plate members with the ends of said second and third shafts being movable in openings defined through said plate members, and wherein said means for moving said first and second distribution rollers between said working and non-working positions comprises a first pair of opposite elongated arms each pivotally connected at one end to a respective end of said first shaft and at the other end to a respective end of said second shaft for pivotal movement about said first shaft, a second pair of opposite elongated arms each pivotally connected at one end to said respective end of said second shaft and at the other end to a respective end of said third shaft, a third pair of opposite elongated arms each pivotally connected at one end to said respective end of said third shaft and at the other end to a respective end of said fourth shaft for pivotal movement about said fourth shaft, so that said first and second distribution rollers are movable in directions towards or away from said first and second transfer rollers, respectively, and actuating means for pivotally moving the arms of said first pair and pivotally moving the arms of said third pair, so that to move said first and second distribution rollers towards or away from said first and second transfer rollers, respectively, and move same between said working and non-working positions.

17. An apparatus as claimed in claim 16, further including stop means on said first and second plate members for arresting the arms of said first and third pairs when said first and second distribution rollers are moved to said working position, so as to limit pressures exerted at said second and fourth nips to preset values.

18. An apparatus as claimed in claim 16, wherein said positive electrode is mounted between opposite vertically extending third and fourth plate members, and wherein said actuating means comprises a pair of opposite elongated actuator arms each connected at a first end thereof to a respective arm of said first pair, a pair of opposite elongated link members each pivotally connected at a first end thereof to a second end of a respective actuator arm and hydraulic means connected between a second end of each said link member and a respective one of said third and fourth plate members, so that when said link members and said actuator arms are moved by said hydraulic means in a first direction said first and second distribution rollers are moved to said working position, and when said link members and said actuator arms are moved by said hydraulic means in a second direction opposite said first direction said first and second distribution rollers are moved to said non-working position.

19. An apparatus as claimed in claim 18, further including means for moving said second transfer roller between a working position whereat said second transfer roller is in said engagement with said positive electrode, and a non-working position whereat said second transfer roller is disengaged from said positive electrode.

20. An apparatus as claimed in claim 19, wherein said first and second plate members are pivotally connected respectively to said third and fourth plate members for pivotal movement about a pivot axis extending parallel to the longitudinal axis of said positive electrode, said second transfer roller being mounted between said first and second plate members, whereby said transfer roller is movable in a direction towards or away from said positive electrode, and wherein said means for moving said second transfer roller between said working and non-working positions comprises abutment means on said first and second plate members for engaging said actuator arms when said link members and said actuator arms are moved by said hydraulic means in said first direction such that said actuator arms abut against said abutment means and pivotally move said first and second plate members with said second transfer roller therebetween towards said positive electrode, so that said second transfer roller is moved to said working position, said first and second plate members, said applicator roller, said first and second distribution rollers and said first and second transfer rollers being disposed relative to said pivot axis to provide a weight distribution such as to cause said first and second plate members to pivotally move away from said positive electrode when said link members and said actuator arms are moved in said second direction, so that said second transfer roller is moved to said non-working position.

21. An apparatus as claimed in claim 20, further including spring means on said first and second plate members for engaging said actuator arms to maintain said first and second distribution rollers in said nonworking position when said second transfer roller is in said non-working position.

22. An apparatus as claimed in claim 20, further including stop means on said first and second plate members for engaging said third and fourth plate members when said second transfer roller is moved to said working position so as to limit pressure exerted at said fifth nip to a preset value.

23. An apparatus as claimed in claim 1, further including means for polishing the olefin and metal oxide-coated positive electrode active surface to increase adherence of said micro-droplets onto said positive electrode active surface.

24. An apparatus as claimed in claim 23, wherein said positive electrode is rotatable in a predetermined direction and wherein said means for polishing the olefin and metal oxide-coated positive electrode active surface comprises an elongated rotatable brush extending parallel to the longitudinal axis of said positive electrode, said brush being provided with a plurality of radially extending bristles having extremities contacting said olefin and metal oxide-coated positive electrode active surface, and means for rotating said brush in a direction opposite to the direction of rotation of said positive electrode so as to cause said bristles to frictionally engage said olefin and metal oxide-coated positive electrode surface and thereby polish same.

25. An apparatus as claimed in claim 1, wherein said means for forming said dots of colored, coagulated colloid comprises:

a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant preset electrode gap, said negative electrodes being spaced from one another by a distance at least equal to said electrode gap;

means for filling said electrode gap with a substantially liquid colloidal dispersion containing said electrolytically coagulable colloid, said coloring agent, a liquid dispersing medium and a soluble electrolyte;

means for electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, so as to form said dots of colored, coagulated colloid; and means for removing any remaining non-coagulated colloid from said positive electrode active surface.

26. An apparatus as claimed in claim 25, wherein said negative electrodes are arranged in an elongated head along the length thereof, said head having a longitudinally axis and being rotatable about the longitudinal axis thereof for moving said negative electrodes between a first position whereat said negative electrode active surfaces are spaced from said positive electrode active surface by said electrode gap and said plane is parallel to a plane extending tangentially to said positive electrode active surface, and a second position whereat said negative electrode active surfaces are exposed to permit cleaning thereof, and wherein said apparatus further includes means for adjustably rotating said head to position said negative electrodes at said first position.

27. An apparatus as claimed in claim 26, further including gap adjustment means for adjustably varying said electrode gap.

28. An apparatus as claimed in claim 27, wherein said positive electrode is mounted between a pair of opposite vertically extending plate members and said head is mounted between a pair of opposite elongated arms each pivotally connected at one end to a respective plate member for pivotal movement about a pivot axis extending parallel to the longitudinal axis of said positive electrode, so that said head is movable in a direction towards or away from said positive electrode, and wherein said gap adjustment means comprises means for adjustably moving said head towards or away from said positive electrode to vary said electrode gap.

29. An apparatus as claimed in claim 25, wherein said means for filling said electrode gap with said colloidal dispersion comprises injector means for continuously injecting said colloidal dispersion under pressure into said electrode gap, in a direction substantially tangent to said positive electrode active surface.

30. An apparatus as claimed in claim 29, wherein said means for removing said non-coagulated colloid from said positive electrode active surface comprises an elongated blade member of resilient material extending parallel to the longitudinal axis of said positive electrode and in pressure contact engagement with said positive electrode active surface for retaining upstream of said blade member excess colloidal dispersion flowing through said electrode gap and carried by said positive electrode, and suction means for sucking up the excess colloidal dispersion retained by said blade member.

31. An apparatus as claimed in claim 30, further including means for collecting the excess colloidal dispersion sucked up by said suction means, and means for recirculating the collected colloidal dispersion back to said injector means.

32. An apparatus as claimed in claim 31, further including means for adding fresh colloidal dispersion to said excess colloidal dispersion upstream of said blade member.

33. An apparatus as claimed in claim 30, wherein said suction means includes a suction head having an elongated body extending parallel to said blade member, said body being provided with conduit means opening closely adjacent said blade member and adapted for connection to suction pump means.

34. An apparatus as claimed in claim 33, wherein said conduit means comprises a primary conduit extending longitudinally of said body, an outlet conduit in fluid communication with said primary conduit and adapted for connection to said suction pump means, and a plurality of spaced-apart secondary conduits extending transversely of said body and opening closely adjacent said blade member, said secondary conduits being in fluid communication with said primary conduit.

35. An apparatus as claimed in claim 33, further including pressure adjustment means for adjustably varying the pressure exerted between said blade member and said positive electrode active surface.

36. An apparatus as claimed in claim 35, wherein said blade member is mounted to an elongated support member and extends longitudinally thereof, said support member is displaceably mounted to the body of said suction head for movement in a direction towards or away from said positive electrode, and wherein said pressure adjustment means comprises means for adjustably moving said support member towards or away from said positive electrode to vary the pressure exerted by said blade member against said positive electrode active surface.

37. An apparatus as claimed in claim 36, wherein said means for adjustably moving said support member towards or away from said positive electrode comprises adjustable screw means threadedly engaged with the body of said suction head and contacting said support member, and spring means urging said support member against said screw means to retain said support member in contact engagement with said screw means.

38. An apparatus as claimed in claim 36, wherein an elongated attachment member extending parallel to the body of said suction head is slidably mounted thereto for movement in a direction towards or away from said positive electrode, and wherein said support member is removably fixed to said attachment member so as to be displaceable therewith in said direction.

39. An apparatus as claimed in claim 36, wherein said suction head is mounted between opposite vertically extending first and second plate members, said positive electrode is mounted between opposite vertically extending third and fourth plate members, and wherein said first and second plate members are pivotally connected respectively to said first and second plate members for pivotal movement about a pivot axis extending parallel to the longitudinal axis of said positive electrode so as to permit said blade member to move between a working position whereat said blade member is in said engagement with said positive electrode active surface and a non-working position whereat said blade member is disengaged from said positive electrode active surface, releasable locking means releasably securing said first and second plate members respectively to said third and fourth plate members when said blade member is in said working position.

40. An apparatus as claimed in claim 1, wherein said substrate is in the form of a continuous web and said means for bringing the web into contact with said colored, coagulated colloid comprises a pressure roller extending parallel to said positive electrode and in pressure contact engagement therewith to form a nip through which said web passes and permit said pressure roller to be driven by said positive electrode upon rotation thereof.

41. An apparatus as claimed in claim 40, further including means for moving said pressure roller between a working position whereat said pressure roller is in said engagement with said positive electrode and a non-working position whereat said pressure roller is disengaged from said positive electrode.

42. An apparatus as claimed in claim 41, wherein said positive electrode is mounted between a pair of opposite vertically extending plate members and said pressure roller is mounted between a pair of opposite bell cranks each having first and second arms and each being pivotally connected to a respective plate member for pivotal movement about a pivot axis extending parallel to the longitudinal axis of said positive electrode, said pressure roller being rotatably mounted between said first arms, so that said pressure roller is movable in a direction towards or away from said positive electrode, and wherein said means for moving said pressure roller between said working and non-working positions comprises hydraulic means connected between each said second arm and said respective plate member for moving said first arms with said pressure roller therebetween towards or away from said positive electrode so as to move said pressure roller between said working and non-working positions.

43. An apparatus as claimed in claim 42, further including stop means on said plate members for arresting said first arms when said pressure roller is moved to said working position to limit pressure exerted at said nip to a predetermined value.

44. An apparatus as claimed in claim 1, wherein said positive electrode is rotatable in a predetermined direction and wherein said cleaning means comprises an elongated rotatable brush extending parallel to the longitudinal axis of said positive electrode, said brush being provided with a plurality of radially extending bristles having extremities contacting said positive electrode active surface, means for rotating said brush in a direction opposite to the direction of rotation of said positive electrode so as to cause said bristles to frictionally engage said positive electrode active surface, and injector means disposed on either side of said brush for directing jets of cleaning liquid under pressure against said positive electrode active surface.

45. An apparatus as claimed in claim 44, wherein said cleaning means further includes means for removing excess cleaning liquid from said positive electrode active surface and ventilation means for evaporating any cleaning liquid remaining thereon.

46. A multicolor electrocoagulation printing apparatus comprising a plurality of printing units arranged in tandem relation and each including:

a positive cylindrical electrode having a central longitudinal axis extending horizontally and a passivated surface defining a positive electrode active surface, said positive electrode being formed of an electrolytically inert metal;

means for rotating said positive electrode about the longitudinal axis thereof at a substantially constant speed;

coating means for coating the positive electrode active surface with an olefinic substance and a metal oxide to form on said surface micro-droplets of olefinic substance containing the metal oxide;

means for forming on the olefin and metal oxide-coated positive electrode active surface a plurality of dots of colored, coagulated colloid by electrocoagulation of an electrolytically coagulable colloid together with a coloring agent of different color, said dots of colored, coagulated colloid being representative of a desired image;

means for bringing a substrate into contact with the dots of colored, coagulated colloid at a respective transfer station to cause transfer of the colored, coagulated colloid from the positive electrode active surface onto said substrate and imprint said substrate with said image; and cleaning means for cleaning said positive electrode active surface to remove therefrom any remaining coagulated colloid, said cleaning means being disposed under said positive electrode and below said coating means; whereby to produce several differently colored images of coagulated colloid which are transferred at said respective transfer stations onto said substrate in superimposed relation to provide a polychromic image.

47. An apparatus as claimed in claim 46, wherein said coating means comprises first and second distribution rollers arranged in spaced-apart parallel relation to one another and to said positive electrode, said first and second distribution rollers each having a peripheral coating comprising an oxide ceramic material, applicator means for applying said olefinic substance in the form of an oily dispersion containing said metal oxide as dispersed phase onto the ceramic coating of said first distribution roller to form on a surface thereof a film of said oily dispersion uniformly covering the surface of said ceramic coating, said film of oily dispersion at least partially breaking down into micro-droplets containing said olefinic substance in admixture with said metal oxide and having substantially uniform size and distribution, first transfer means arranged between said first distribution roller and said second distribution roller for transferring the at least partially broken film from said first distribution to said second distribution roller so as to cause said film to substantially completely break on the ceramic coating of said second distribution roller into said micro-droplets having a substantially uniform size and distribution, and second transfer means arranged between said second distribution roller and said positive electrode for transferring said micro-droplets from the ceramic coating of said second distribution roller onto said positive electrode active surface.

48. An apparatus as claimed in claim 47, wherein the ceramic coatings of said first distribution roller and said second distribution roller comprise the same oxide ceramic material, and wherein said oxide ceramic material comprises a fused mixture of alumina and titania.

49. An apparatus as claimed in claim 47, wherein said applicator means comprises an applicator roller extending parallel to said first distribution roller and in pressure contact engagement therewith to form a first nip, means for rotating said applicator roller and said first distribution roller in register and feed means for supplying said oily dispersion to said applicator roller, whereby said oily dispersion is carried to said first nip by said applicator roller during rotation thereof and upon passing through said first nip forms said film uniformly covering the surface of said ceramic coating.

50. An apparatus as claimed in claim 49, wherein said feed means comprises a receptacle for containing a bath of said oily dispersion, a feed roller extending parallel to said applicator roller, said feed roller having a plurality of elongated paddle members extending longitudinally thereof and each adapted to be at least partially immersed in said bath, said paddle members being arranged in spaced-apart relationship about said feed roller such that one of said paddle members is positioned to contact said applicator roller, and means for rotating said feed roller to move said one paddle member to a non-contact position with an adjacent paddle member coated with said oily dispersion being moved to contact said applicator roller so as to transfer thereon said oily dispersion.

51. An apparatus as claimed in claim 50, wherein said paddle members are adapted to agitate said bath during rotation of said feed roller so as to disperse said metal oxide in said olefinic substance and thereby form said oily dispersion.

52. An apparatus as claimed in claim 51, wherein said paddle members are formed of a resilient material which is resistant to attack by oil.

53. An apparatus as claimed in claim 52, wherein said resilient, oil-resistant material is a synthetic rubber material.

54. An apparatus as claimed in claim 53, wherein said synthetic rubber material comprises a nitride.

55. An apparatus as claimed in claim 49, wherein said first transfer means comprises a first transfer roller extending parallel to said first and second distribution rollers, in pressure contact engagement with said first distribution roller to form a second nip and in contact engagement with said second distribution roller to form a third nip, and means for rotating said first transfer roller and said first distribution roller in register, so that said at least partially broken film is transferred from said first distribution roller to said first transfer roller at said second nip and thereafter from said first transfer roller to said second distribution roller at said third nip.

56. An apparatus as claimed in claim 55, wherein said second transfer means comprises a second transfer roller extending parallel to said second distribution roller and in pressure contact engagement therewith to form a fourth nip, said second transfer roller being in pressure contact engagement with said positive electrode to form a fifth nip and permit said second transfer roller to be driven by said positive electrode and said second distribution roller to be driven by said second transfer roller upon rotation of said positive electrode, so that said micro-droplets are transferred from said second distribution roller to said second transfer roller at said fourth nip and thereafter from said second transfer roller to said positive electrode at said fifth nip.

57. An apparatus as claimed in claim 56, wherein said applicator roller, said first transfer roller and said second transfer roller are each provided with a peripheral covering of a resilient material which is resistant to attack by said olefinic substance.

58. An apparatus as claimed in claim 57, wherein said resilient, oil-resistant material is a synthetic rubber material.

59. An apparatus as claimed in claim 58, wherein said synthetic rubber material comprises a polyurethane.

60. An apparatus as claimed in claim 56, wherein each said printing unit further includes means for moving said first and second distribution rollers between a working position whereat said first distribution roller is in said engagement with said first transfer roller and said second distribution roller is in said engagement with said second transfer roller, and a non-working position whereat said first distribution roller is disengaged from said first transfer roller and said second distribution roller is disengaged from said second transfer roller.

61. An apparatus as claimed in claim 60, wherein said applicator roller, said first and second distribution rollers and said first transfer rollers have respectively first, second, third and fourth central longitudinally extending shafts and are mounted between opposite vertically extending first and second plate members with the ends of said second and third shafts being movable in openings defined through said plate members, and wherein said means for moving said first and second distribution rollers between said working and non-working positions comprises a first pair of opposite elongated arms each pivotally connected at one end to a respective end of said first shaft and at the other end to a respective end of said second shaft for pivotal movement about said first shaft, a second pair of opposite elongated arms each pivotally connected at one end to said respective end of said second shaft and at the other end to a respective end of said third shaft, a third pair of opposite elongated arms each pivotally connected at one end to said respective end of said third shaft and at the other end to a respective end of said fourth shaft for pivotal movement about said fourth shaft, so that said first and second distribution rollers are movable in directions towards or away from said first and second transfer rollers, respectively, and actuating means for pivotally moving the arms of said first pair and thereby pivotally moving the arms of said third pair, so as to move said first and second distribution rollers towards or away from said first and second transfer rollers, respectively, and move same between said working and non-working positions.

62. An apparatus as claimed in claim 61, wherein each said printing unit further includes stop means on said first and second plate members for arresting the arms of said first and third pairs when said first and second distribution rollers are moved to said working position, so as to limit pressures exerted at said second and fourth nips to preset values.

63. An apparatus as claimed in claim 61, wherein said positive electrode is mounted between opposite vertically extending third and fourth plate members, and wherein said actuating means comprises a pair of opposite elongated actuator arms each connected at a first end thereof to a respective arm of said first pair, a pair of opposite elongated link members each pivotally connected at a first end thereof to a second end of a respective actuator arm and hydraulic means connected between a second end of each said link member and a respective one of said third and fourth plate members, whereby when said link members and said actuator arms are moved by said hydraulic means in a first direction said first and second distribution rollers are moved to said working position, and when said link members and said actuator arms are moved by said hydraulic means in a second direction opposite said first direction said first and second distribution rollers are moved to said non-working position.

64. An apparatus as claimed in claim 63, wherein each said printing unit further includes means for moving said second transfer roller between a working position whereat said second transfer roller is in said engagement with said positive electrode, and a non-working position whereat said second transfer roller is disengaged from said positive electrode.

65. An apparatus as claimed in claim 64, wherein said first and second plate members are pivotally connected respectively to said third and fourth plate members for pivotal movement about a pivot axis extending parallel to the longitudinal axis of said positive electrode, said second transfer roller being mounted between said first and second plate members, whereby said transfer roller is movable in a direction towards or away from said positive electrode, and wherein said means for moving said second transfer roller between said working and non-working positions comprises abutment means on said first and second plate members for engaging said actuator arms when said link members and said actuator arms are moved by said hydraulic means in said first direction such that said actuator arms abut against said abutment means and thereby pivotally move said first and second plate members with said second transfer roller therebetween towards said positive electrode, so that said second transfer roller is moved to said working position, said first and second plate members, said applicator roller, said first and second distribution rollers and said first and second transfer rollers being disposed relative to said pivot axis to provide a weight distribution so as to cause said first and second plate members to pivotally move away from said positive electrode when said link members and said actuator arms are moved in said second direction, so that said second transfer roller is moved to said non-working position.

66. An apparatus as claimed in claim 65, wherein each said printing unit further includes spring means on said first and second plate members for engaging said actuator arms to maintain said first and second distribution rollers in said non-working position when said second transfer roller is in said non-working position.

67. An apparatus as claimed in claim 65, wherein each said printing unit further includes stop means on said first and second plate members for engaging said third and fourth plate members when said second transfer roller is moved to said working position so as to limit pressure exerted at said fifth nip to a preset value.

68. An apparatus as claimed in claim 46, wherein each said printing unit further includes means for polishing the olefin and metal oxide-coated positive electrode active surface to increase adherence of said micro-droplets onto said positive electrode active surface.

69. An apparatus as claimed in claim 68, wherein said positive electrode is rotatable in a preset direction and wherein said means for polishing the olefin and metal oxide-coated positive electrode active surface comprises an elongated rotatable brush extending parallel to the longitudinal axis of said positive electrode, said brush being provided with a plurality of radially extending bristles having extremities contacting said olefin and metal oxide-coated positive electrode active surface, and means for rotating said brush in a direction opposite to the direction of rotation of said positive electrode so as to cause said bristles to frictionally engage said olefin and metal oxide-coated positive electrode surface and thereby polish same.

70. An apparatus as claimed in claim 46, wherein said means for forming said dots of colored, coagulated colloid comprises:

a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant preset electrode gap, said negative electrodes being spaced from one another by a distance at least equal to said electrode gap;

means for filling said electrode gap with a substantially liquid colloidal dispersion containing said electrolytically coagulable colloid, said coloring agent, a liquid dispersing medium and a soluble electrolyte;

means for electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, so as to form said dots of colored, coagulated colloid; and means for removing any remaining non-coagulated colloid from said positive electrode active surface.

71. An apparatus as claimed in claim 70, wherein said negative electrodes are arranged in an elongated herd along the length thereof, said head having a longitudinally axis and being rotatable about the longitudinal axis thereof for moving said negative electrodes between a first position whereat said negative electrode active surfaces are spaced from said positive electrode active surface by said electrode gap and said plane is parallel to a plane extending tangentially to said positive electrode active surface, and a second position whereat said negative electrode active surfaces are exposed to permit cleaning thereof, and wherein each said printing unit further includes means for adjustably rotating said head to position said negative electrodes at said first position.

72. An apparatus as claimed in claim 71, wherein each said printing unit further includes gap adjustment means for adjustably varying said electrode gap.

73. An apparatus as claimed in claim 72, wherein said positive electrode is mounted between a pair of opposite vertically extending plate members and said head is mounted between a pair of opposite elongated arms each pivotally connected at one end to a respective plate member for pivotal movement about a pivot axis extending parallel to the longitudinal axis of said positive electrode, so that said head is movable in a direction towards or away from said positive electrode, and wherein said gap adjustment means comprises means for adjustably moving said head towards or away from said positive electrode so as to vary said electrode gap.

74. An apparatus as claimed in claim 73, wherein aid means for filling said electrode gap with said colloidal dispersion comprises injector means for continuously injecting said colloidal dispersion under pressure into said electrode gap, in a direction substantially tangent to said positive electrode active surface.

75. An apparatus as claimed in claim 74, wherein said means for removing said non-coagulated colloid from said positive electrode active surface comprises an elongated blade member of resilient material extending parallel to the longitudinal axis of said positive electrode and in pressure contact engagement with said positive electrode active surface for retaining upstream of said blade member excess colloidal dispersion flowing through said electrode gap and carried by said positive electrode, and suction means for sucking up the excess colloidal dispersion retained by said blade member.

76. An apparatus as claimed in claim 75, wherein each said printing unit further includes means for collecting the excess colloidal dispersion sucked up by said suction means, and means for recirculating the collected colloidal dispersion back to said injector means.

77. An apparatus as claimed in claim 76, wherein each said printing unit further includes means for adding fresh colloidal dispersion to said excess colloidal dispersion upstream of said blade member.

78. An apparatus as claimed in claim 75, wherein said suction means includes a suction head having an elongated body extending parallel to said blade member, said body being provided with conduit means opening closely adjacent said blade member and adapted for connection to suction pump means.

79. An apparatus as claimed in claim 78, wherein said conduit means comprises a primary conduit extending longitudinally of said body, an outlet conduit in fluid communication with said primary conduit and adapted for connection to said suction pump means, and a plurality of spaced-apart secondary conduits extending transversely of said body and opening closely adjacent said blade member, said secondary conduits being in fluid communication with said primary conduit.

80. An apparatus as claimed in claim 78, wherein each said printing unit further includes pressure adjustment means for adjustably varying the pressure exerted between said blade member and said positive electrode active surface.

81. An apparatus as claimed in claim 80, wherein said blade member is mounted to an elongated support member and extends longitudinally thereof, said support member is displaceably mounted to the body of said suction head for movement in a direction towards or away from said positive electrode, and wherein said pressure adjustment means comprises means for adjustably moving said support member towards or away from said positive electrode to thereby vary the pressure exerted by said blade member against said positive electrode active surface.

82. An apparatus as claimed in claim 81, wherein said means for adjustably moving said support member towards or away from said positive electrode comprises adjustable screw means threadedly engaged with the body of said suction head and contacting said support member, and spring means urging said support member against said screw means to retain said support member in contact engagement with said screw means.

83. An apparatus as claimed in claim 81, wherein an elongated attachment member extending parallel to the body of said suction head is slidably mounted thereto for movement in a direction towards or away from said positive electrode, and wherein said support member is removably fixed to said attachment member so as to be displaceable therewith in said direction.

84. An apparatus as claimed in claim 81, wherein said suction head is mounted between opposite vertically extending first and second plate members, said positive electrode is mounted between opposite vertically extending third and fourth plate members, and wherein said first and second plate members are pivotally connected respectively to said first and second plate members for pivotal movement about a pivot axis extending parallel to the longitudinal axis of said positive electrode to thereby permit said blade member to move between a working position whereat said blade member is in said engagement with said positive electrode active surface and a non-working position whereat said blade member is disengaged from said positive electrode active surface, releasable locking means releasably securing said first and second plate members respectively to said third and fourth plate members when said blade member is in said working position.

85. An apparatus as claimed in claim 46, wherein said substrate is in the form of a continuous web and said means for bringing the web into contact with said colored, coagulated colloid at said respective transfer station comprises a pressure roller extending parallel to said positive electrode and in pressure contact engagement therewith to form a nip through and permit said pressure roller to be driven by said positive electrode upon rotation thereof, and means for guiding said web so as to pass through said nip at said respective transfer station.

86. An apparatus as claimed in claim 85, wherein each said printing unit further includes means for moving said pressure roller between a working position whereat said pressure roller is in said engagement with said positive electrode and a non-working position whereat said pressure roller is disengaged from said positive electrode.

87. An apparatus as claimed in claim 86, wherein said positive electrode is mounted between a pair of opposite vertically extending plate members and said pressure roller is mounted between a pair of opposite bell cranks each having first and second arms and each being pivotally connected to a respective plate member for pivotal movement about a pivot axis extending parallel to the longitudinal axis of said positive electrode, said pressure roller being rotatably mounted between said first arms, so that said pressure roller is movable in a direction towards or away from said positive electrode, and wherein said means for moving said pressure roller between said working and nonworking positions comprises hydraulic means connected between each said second arm and said respective plate member for moving said first arms with said pressure roller therebetween towards or away from said positive electrode so as to move said pressure roller between said working and non-working positions.

88. An apparatus as claimed in claim 87, wherein each said printing unit further includes stop means on said plate members for arresting said first arms when said pressure roller is moved to said working position to limit pressure exerted at said nip to a predetermined value.

89. An apparatus as claimed in claim 46, wherein said positive electrode is rotatable in a preset direction and wherein said cleaning means comprises an elongated rotatable brush extending parallel to the longitudinal axis of said positive electrode, said brush being provided with a plurality of radially extending bristles having extremities contacting said positive electrode active surface, means for rotating said brush in a direction opposite to the direction of rotation of said positive electrode so as to cause said bristles to frictionally engage said positive electrode active surface, and injector means disposed on either side of said brush for directing jets of cleaning liquid under pressure against said positive electrode active surface.

90. An apparatus as claimed in claim 89, wherein said cleaning means further includes means for removing excess cleaning liquid from said positive electrode active surface and ventilation means for evaporating any cleaning liquid remaining thereon.

* * * * *